US010614782B1

(12) United States Patent
Skaggs

(10) Patent No.: US 10,614,782 B1
(45) Date of Patent: Apr. 7, 2020

(54) DRUM COUPLING ASSEMBLIES

(71) Applicant: Jacob Aaron Skaggs, Houston, TX (US)

(72) Inventor: Jacob Aaron Skaggs, Houston, TX (US)

( * ) Notice: Subject to any disclaimer, the term of this patent is extended or adjusted under 35 U.S.C. 154(b) by 0 days.

(21) Appl. No.: 16/281,030

(22) Filed: Feb. 20, 2019

Related U.S. Application Data

(63) Continuation-in-part of application No. 16/039,011, filed on Jul. 18, 2018, now abandoned.

(60) Provisional application No. 62/534,498, filed on Jul. 19, 2017.

(51) Int. Cl.
*G10D 13/02* (2020.01)

(52) U.S. Cl.
CPC ..... *G10D 13/021* (2013.01); *G10D 13/023* (2013.01); *G10D 13/027* (2013.01); *G10D 13/028* (2013.01)

(58) Field of Classification Search
CPC .. G10D 13/021; G10D 13/027; G10D 13/028; G10D 13/023
See application file for complete search history.

(56) References Cited

U.S. PATENT DOCUMENTS 2,204,987 A * 6/1940 Gussak ..... G10D 13/023 84/412
2003/0061929 A1* 4/2003 Dye ..... G10D 13/02 84/411 R
2013/0125730 A1* 5/2013 Jones ..... G10D 13/021 84/414

* cited by examiner

*Primary Examiner* — Kimberly R Lockett
(74) *Attorney, Agent, or Firm* — Matthew D. Thayne; Thayne and Davis LLC

(57) ABSTRACT

The disclosure herein includes a drum coupling assembly, which drum coupling assembly may include: a drum having a drum hoop and a drumhead; a first clamp coupled to the drum hoop; a second clamp coupled to the drum hoop; and an elastic cord coupled to the first clamp and the second clamp, an elastic cord, wherein at least a portion of the elastic cord extends between the first clamp and the second clamp, and wherein at least a portion of the elastic cord is disposed between an edge of the drum hoop and above the drumhead.

14 Claims, 28 Drawing Sheets

DRUM COUPLING ASSEMBLIES

RELATED APPLICATIONS

This application is a continuation-in-part of and claims benefit to co-pending application number Ser. No. 16/039,011, filed on Jul. 18, 2018, which claims priority to provisional application No. 62/534,498 filed on Jul. 19, 2017, and hereby incorporates both non-provisional application Ser. No. 16/039,011 and provisional application number 62/534,498 by reference as if set forth in their entireties.

BACKGROUND

Field of Inventions

The field of this application and any resulting patent is drum coupling assemblies.

Description of Related Art

Many percussionists, such as drummers, put various materials and objects against a drumhead for the purpose of adding to, changing and/or controlling the sound of a drum. Common objects placed against a drumhead to achieve certain sounds, tones and/or effects are: tape, gel, foam, wallets, cell-phones, tambourines, shakers, rattles, cymbals, etc.

An object may produce a desired tone when initially placed at a certain location with a certain orientation and/or pressure against a drumhead. However, the object will often not stay where it was initially placed while the drum is being played due to the angle of the drumhead surface, vibrations of the drum, and/or the object being struck by the percussionist who is playing the drum. An object moved into an undesired position and/or orientation on a drumhead can produce undesired tones, disrupt the playing of the drum, and/or fall off the drum completely.

Adhesives are often used to dampen a drum's tone and/or fasten one or more objects to a drumhead of the drum. However, when adhesives are used, repositioning those objects can be difficult, the drumhead may get damaged, the full vibration and resonance of the drum would be impeded, and adhesives eventually lose their functionality as they collect dust and other particulates. For percussionists these issues present some serious problems because percussionists may desire to change and/or modify the sounds, tones, and effects coming from their drums quickly and easily depending on the piece of music they are playing and/or the venue where they are playing it because qualities and dimensions of the venue may affect perception of sound produced from the drum. Qualities of a venue may include building materials and ambient surroundings. Dimensions of a venue may include size and shape.

Some specific accessories are designed to produce certain percussive effects and stay in place with the use of brackets or mounts, which attach to a drum rim or hoop. However, these accessories have shortcomings, e.g., limitation to one type of effect/use and/or limited positioning.

Various drum coupling assemblies and methods for coupling percussive effect objects to drumheads have been proposed and utilized, including some of the methods and structures disclosed in some of the references appearing on the face of this application. However, those methods and structures lack the combination of steps and/or features of the methods and/or structures covered herein. Furthermore, it is contemplated that certain of the methods and/or structures disclosed herein solve many of the problems that prior art methods and structures have failed to solve. Also, the methods and/or structures disclosed herein have benefits that would be surprising and unexpected to a hypothetical person of ordinary skill with knowledge of the prior art existing as of the filing date of this application.

SUMMARY

The disclosure herein includes a drum coupling assembly, which drum coupling assembly may include: a drum having a drum hoop and a drumhead; a first clamp coupled to the drum hoop; a second clamp coupled to the drum hoop; and an elastic cord coupled to the first clamp and the second clamp, an elastic cord, wherein at least a portion of the elastic cord extends between the first clamp and the second clamp, and wherein at least a portion of the elastic cord is disposed between an edge of the drum hoop and the drumhead.

The disclosure herein includes a drum coupling assembly, which drum coupling assembly may include: a drum having a drum hoop and a drumhead; a first clamp coupled to the drum hoop; a second clamp coupled to the drum hoop; and an elastic cord coupled to the first clamp and the second clamp, wherein the first clamp and the second clamp may hold a portion of the elastic cord between an edge of the drum hoop and the drumhead.

The disclosure herein includes a drum coupling assembly, which drum coupling assembly may include: a first clamp capable of being coupled to a drum hoop of a drum; a second clamp capable of being coupled to the drum hoop; and an elastic cord coupled to the first clamp and the second clamp, wherein the first clamp and the second clamp may be capable holding a portion of the elastic cord in an opening of the drum hoop.

The disclosure herein includes a drum coupling assembly, which drum coupling assembly may include: a first clamp capable of being coupled to a drum hoop of a drum, the first clamp having an aperture; a second clamp capable of being coupled to the drum hoop, the second clamp having an aperture; and an elastic cord extending through the aperture of the first clamp and the aperture of the second clamp, wherein a portion of the elastic cord may be capable of being disposed within an opening of the drum hoop.

The disclosure herein includes a drum coupling assembly, which drum coupling assembly may include: a first clamp capable of being coupled to a drum hoop of a drum, the first clamp having a first terminal having an aperture; a second clamp capable of being coupled to the drum hoop, the second clamp having a second terminal having an aperture; and an elastic cord extending through the aperture of the first terminal and the aperture of the second terminal, wherein the first terminal and the second terminal may be capable of holding a portion of the elastic cord between an edge of the drum hoop and a drumhead of the drum.

The disclosure herein includes a drum coupling assembly, which drum coupling assembly may include: a first clamp capable of being coupled to a hoop of a drum, the first clamp having an aperture; a second clamp capable of being coupled to the hoop, the second clamp having an aperture; and an elastic cord extending through the aperture of the first clamp and the aperture of the second clamp.

The disclosure herein includes a drum coupling assembly, which drum coupling assembly may include: a first clamp capable of being coupled to a drum hoop of a drum; a second clamp capable of being coupled to the drum hoop; and an elastic cord coupled to the first clamp and the second clamp, wherein the first clamp and the second clamp may be capable of holding a portion of the elastic cord between an edge of the drum hoop and a drumhead of the drum.

The disclosure herein includes a method of coupling a drum coupling assembly to a drum, which method may include: coupling a first clamp to a drum hoop of a drum; coupling a second clamp to the drum hoop; extending an elastic cord across a drumhead of the drum; and holding, with the first clamp and the second clamp, a portion of the elastic cord in an opening of the drum hoop.

DETAILED DESCRIPTION

1. Introduction

Figure 1:
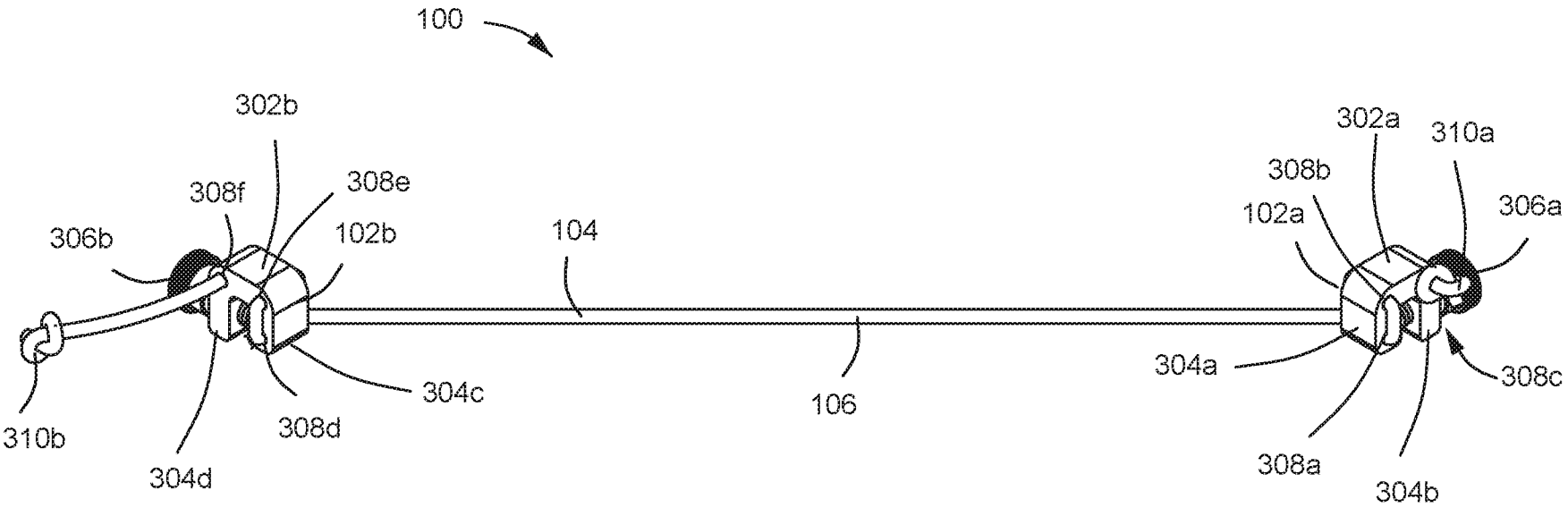
FIG. 1 illustrates a perspective view of a drum coupling assembly including two clamps, in which each clamp has three apertures disposed therein, and a cord coupled to the two clamps.

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

2. Selected Definitions

Certain claims include one or more of the following terms which, as used herein, are expressly defined below.

The term "abutted against" as used herein is defined as being positioned adjacent to and either physically touching or pressing against, directly or indirectly. For example, a first object may be abutted against a second object such that the second object is limited from moving in a direction of the first object. Thus, a clamp may have a terminal abutted against a drum hoop. Also, a thumb screw may have a portion abutted against a drum hoop.

The term "aligning" as used herein is a verb that means manufacturing, forming, adjusting, or arranging one or more physical objects into a particular position. After any aligning takes place, the objects may be fully or partially "aligned." Aligning preferably involves arranging a structure or surface of a structure in linear relation to another structure or surface; for example, such that their borders or perimeters may share a set of parallel tangential lines. In certain instances, the aligned borders or perimeters may share a similar profile. Additionally, apertures may be aligned, such that a structure or portion of a structure may be extended into and/or through the apertures.

The term "aperture" as used herein is defined as any opening in a solid object or structure, e.g., drum, drum hoop, clamp, clamp terminal, clamp body, cord lock, or tubular. For example, an aperture may be an opening that begins on one side of a solid object, e.g., drum hoop, clamp, clamp terminal, clamp body, cord lock, or tubular, and ends on the other side of the object. An aperture may alternatively be an opening that does not pass entirely through an object, but only partially passes through, e.g., a groove. An aperture can be an opening in an object, e.g., drum, drum hoop, clamp, clamp terminal, clamp body, cord lock, or tubular, that is completely circumscribed, defined, or delimited by the object itself. Alternatively, an aperture can be an opening formed when one object, e.g., drum, drum hoop, clamp, clamp terminal, clamp body, cord lock, or tubular, is combined with one or more other objects or structures. An aperture may receive an object, e.g., cord or pin of a cord lock. For example, a cord may be received in an aperture of a terminal or a body of a clamp or pin and/or body of a cord lock. Additionally, a restraining portion of a cord may be received within an opening of a drum hoop.

The term "assembly" as used herein is defined as any set of components that have been fully or partially assembled together. A group of assemblies may be coupled to form a solid body having an inner surface and an outer surface.

The term "clamp" as used herein is defined as an assembly capable of being removably coupled to another object using pressure. Parts of a clamp may be pressed against a drum and/or a drum hoop. A clamp is capable of being removably coupled to a drum and/or a drum hoop. A clamp may have a body, a first terminal, and a second terminal. A clamp may have a body, a first terminal, and a second terminal that are a unitary single molded rigid piece. A clamp may be molded, 3D-printed, or carved from a single piece of material, e.g., plastic, carbon fiber, metal, or wood. Further, a clamp may include a thumb screw. A clamp may have a body capable of being abutted against an edge, e.g., lip or rim, of a drum hoop of a drum. A clamp may have a body capable of being abutted against an upper edge of a drum hoop. A clamp may have a body capable of being abutted against a lower edge of a drum hoop. A clamp may have a first terminal extending from a first end of a body of the clamp. A clamp may have a second terminal extending from a second end of a body of the clamp. A clamp may have the shape of a block-letter "C" or "G." A clamp may have a terminal threadably coupled to a thumb screw. A clamp may include one or more apertures disposed laterally therethrough. A body of a clamp may include one or more apertures disposed laterally therethrough. A terminal of a clamp may include one or more apertures disposed laterally therethrough. A clamp may have a screw pressed against an outer surface of a drum hoop and a terminal pressed against an inner surface of the drum hoop. A clamp may be a G-clamp, a C-clamp, a clip, a latch, a hook, fasteners, or a lock.

The term "cord" as used herein used is defined as an elongated and flexible structure. Examples of a cord may be a bungee, a rubber band, a strap, a rope, a string, a cable, a wire, and/or a ribbon. A cord may be cylindrical. A cord may be constructed from resilient and/or elastic material, e.g., plastic, latex, rubber, nitrile rubber, butyl rubber, silicone, and/or neoprene. A cord may be resiliently deformed, e.g., bent or stretched by being pulled and/or pushed. Thus, a cord deformed from an original state may return to the original state. Pulling and/or pushing a cord may increase tension, e.g., force, on the cord. A cord may be capable of ingress and/or egress through an aperture of an object, e.g., clamp, clamp terminal, clamp body, or cord lock. A cord may have various structures, e.g., clip, pin, tape, sleeve, latch, hook, fastener, or lock, coupled to an end of the cord that, in some cases, may inhibit the end from egress through a portion of a clamp. A cord may have various materials or chemicals, e.g., adhesive, glue, or epoxy, disposed on an end of the cord and a portion of a clamp that, in some cases, may inhibit the end from egress through the portion. A cord may be slidably coupled to a clamp. A cord may have an outer diameter greater than a diameter of a surface defining an aperture disposed through a clamp. A cord may have an outer surface that is in physical contact with a surface defining an aperture through a clamp. Physical contact between an outer surface of a cord and a surface defining an aperture through a clamp may inhibit the cord from being slid through the aperture. When pulled, a cord would have a diameter smaller than a diameter of a surface defining an aperture disposed through a clamp. A cord may be extended, e.g., laced, through an aperture disposed in a clamp. A cord may have an end capable of being tied into a knot (see, e.g., 310, FIGS. 1-4 and 15-19). A cord may have a knot capable of being abutted against a clamp. A cord may have a knot capable of inhibiting the cord from being slid out of a clamp. A cord may be slidably coupled to a cord lock. One or more portions of a cord may be disposed between two portions of an inner surface of a drum hoop. One or more portions of a cord may be disposed within an aperture of a drum hoop. A cord may have a restraining portion between a first clamp and a second clamp. A cord may have a restraining portion disposed within an aperture of a drum hoop. A cord may have a restraining portion removably coupled to a percussive effects object. A cord may have a restraining portion disposed substantially parallel to a drumhead. A cord may be in physical contact with and/or abutted against a drumhead. Preferably, a cord is not in physical contact with a drumhead. A cord may be disposed as close as 1.0, 2.0, 3.0, 4.0 or 5.0 millimeters or as far as 1.0, 2.0, 3.0, or 4.0 centimeters or farther from a drumhead. A portion of a cord may be said to be disposed between an edge of a drum hoop and a drumhead if the portion is disposed between the drumhead and a plane that is tangent to the edge and parallel to the drumhead. Additionally, a portion of a cord may be said to be disposed between an edge of a drum hoop and a drumhead if the portion is disposed at a first distance from the drumhead less than a second distance from the edge to the drumhead.

The term "cord lock" as used herein used is defined as a device configured for coupling to a cord. A cord lock may be coupled to a cord and may be abutted against a clamp. A cord lock may include a tubular body, a pin disposed concentrically within the tubular body, and a spring disposed between the pin and the tubular body. A cord lock may have a pin slidably coupled to a tubular body. A cord lock may have a spring abutted against a tubular body and a pin such that the spring may cause the tubular body and the pin to be biased away from each other. A cord lock may have apertures disposed through a tubular body and a pin in which the apertures are capable of being aligned. A cord lock may have apertures through which a cord may be capable of slidable ingress or egress, or both. When a pin and a tubular body of a cord lock are biased away from each other, the pin and the tubular body would be pressed against a cord. Accordingly, the cord would be inhibited from ingress or egress through the apertures of the pin and the tubular body.

The term "coupled" as used herein is defined as directly or indirectly connected, attached, or part of. A first object may be coupled to a second object such that the first object is positioned at a specific location and orientation with respect to the second object. For example, a cord may be coupled to a clamp. A first object may be either permanently, removably, slidably, and/or threadably coupled to a second object. Two objects may be removably coupled to each other via knots, threads, tape, latches, hooks, fasteners, locks, male and female connectors, clips, clamps, and/or surface-to-surface contact. For instance, a percussive effects object would be removably coupled to a drumhead of a drum and a cord of a drum coupling assembly if the percussive effects object is positioned adjacent to or abutted against the drumhead and the cord. In another example, a clamp and a drum hoop may be removably coupled to each other such that the clamp may then be uncoupled and removed from the drum hoop. In addition, a cord may be coupled to a clamp such that the cord and the clamp may then be uncoupled. Two objects may be slidably coupled together, e.g., where an inner aperture of one object is capable of receiving a second object. For example, a cord extending through an aperture of a clamp may be slidably coupled to the clamp. An outer surface of the cord may be abutted against an inner surface that defines the aperture of the clamp. The cord may be pulled or slid through the aperture of the clamp. As the cord is pulled, the outer surface of the cord may have a diameter that is smaller than a diameter of the inner surface that defines the aperture of the clamp. In another example, a body and/or terminal of a clamp and a body and pin of a cord lock having apertures through which a cord may be slid. Additionally, two objects may be capable of being threadably coupled, e.g., where a threaded outer surface of one object is capable of engaging with a threaded inner surface of another object. Threadably coupled objects may be removably coupled. Accordingly, a thumb screw may be threadably coupled to a terminal of a clamp where a threaded inner surface, e.g., box threads or female threads, of the terminal may be engaged with a threaded outer surface, e.g., pin threads or male threads, of the thumb screw.

The term "cylindrical" as used herein is defined as shaped like a cylinder, e.g., having straight parallel sides and a circular or oval or elliptical cross-section. A cylindrical body or structure, e.g., drum, drum hoop, thumb screw, or cord lock, may be completely or partially shaped like a cylinder. A cylindrical body, e.g., drum, drum hoop, thumb screw, or cord lock, that has an inner or outer diameter that changes abruptly may have a "flange" e.g., radial face, rim, or lip, extending toward or away from the center axis (see, e.g., 312, FIG. 9). Additionally, a cylindrical body, e.g., drum, drum hoop, rim, thumb screw, or cord lock, may have a flange that is tapered or radiused. A cylindrical body may have an aperture extending through the entire length of the body to form a hollow cylinder that is capable of permitting another body, e.g., clamp, cord, and/or percussion effects object, to be extended or passed through.

The term "drum" as used herein is defined as an instrument capable of being struck, e.g., by objects, sticks, and/or hands, to produce sound. A drum may include a drum shell, a drum hoop, and a drumhead.

The term "drumhead" as used herein is defined as a membrane covering an opening of a drum shell. A drumhead may be planar. A drumhead may have a plane parallel to a restraining portion of a cord.

The term "drum hoop" as used herein is defined as a cylindrical structure that is capable of coupling a drumhead to a drum shell. A drum hoop may have an inner surface and an outer surface. A drum hoop may have an inner surface that defines a perimeter. A drum hoop may have an inner surface that defines an opening therethrough. A drum hoop may have an upper edge. In some cases, a drum hoop may be facing the ground; therefore, the drum hoop may have a lower edge. A drum hoop may have an edge capable of being abutted against a body of a clamp. A drum hoop may have an inner surface capable of being abutted against a terminal of a clamp. A drum hoop may have an outer surface capable of being abutted against a screw of a clamp.

The term "edge" as used herein is defined as any line or border at which any surface terminates, or any line at which two surfaces of a solid object meet. For example, a drum hoop may have an inner surface and an outer surface forming an edge where they meet.

The terms "first" and "second" as used herein merely differentiate two or more things or actions, and do not signify anything else, including order of importance, sequence, etc.

The term "holding" as used herein is a verb that means as keeping, e.g., sustaining, retaining, confining, bearing, and/or supporting, an object in one position. For example, a clamp having a terminal coupled to an inner surface of a drum hoop of a drum may hold a portion of a cord (coupled to the terminal) within a perimeter defined by the inner surface of a drum hoop. In other words, the terminal may be holding the portion of the cord in an opening of the drum hoop.

The term "orthogonal" as used herein is defined as at an angle ranging from 85° or 88 to 92° or 95°. Two structures that are orthogonal to each other may be perpendicular and/or tangential to each other.

The term "parallel" as used herein is defined as having sides that, in some cases, do not intersect or intersect to form an angle ranging from 1°, 2°, or 3° to 4° or 5°.

The term "providing" as used herein is defined as making available, furnishing, supplying, equipping, or causing to be placed in position.

The term "percussive effects object" as used herein is defined as a structure capable of being removably coupled to a cord and/or a drumhead of a drum. A percussive effects object may include one from a group of tambourines, shakers, rattles, cymbals, chains, toys, or pieces of metal, foam, fabric, or strings, etc.

The term "surface" as used herein is defined as any face of a structure. A surface may also refer to that flat or substantially flat area extending radially around a cylinder which may, for example, be part of a drum or drum hoop. A surface may also refer to that flat or substantially flat area that extend radially around a cylinder which may, for example, be part of a drum, a drum hoop, a drumhead, a terminal of a clamp, or a body of a clamp. A surface may have irregular contours. A surface may be formed from components, e.g. a drum hoop, a drumhead, a terminal of a clamp, or a body of a clamp, coupled together. Coupled components may form irregular surfaces.

The term "terminal" as used herein is defined as a structure of a clamp capable of being abutted against a surface of a drum hoop. A terminal may extend from a body of a clamp. A terminal and a body of a clamp may be unitary. A terminal of a clamp may be disposed parallel to a surface of a drum hoop. A terminal may include one or more apertures disposed laterally therethrough. A terminal may be threadably coupled to a thumb screw. A terminal may be configured to be disposed within a perimeter defined by an inner surface drum hoop. A terminal may be configured to be disposed in an aperture defined by an inner surface drum hoop.

The term "threaded" as used herein is defined as having threads. Threads may include one or more helical protrusions or grooves on a surface of a cylindrical object. Each full rotation of a protrusion or groove around a threaded surface of the object is referred to herein as a single "thread." Threads formed on an inner surface of an object, e.g., terminal of a clamp, may be referred to as box threads or female threads. Threads formed on an outer surface of an object, e.g., thumb screw, may be referred to as pin threads or male threads. A threaded assembly may include a "threaded portion" wherein a section of the threaded assembly includes threads, e.g., pin threads or box threads. In certain cases, a threaded portion of a structure may be removably coupled to a threaded assembly.

The term "screw" as used herein is defined any structure that includes threads used for coupling two objects together. A screw may be capable of threadable ingress or egress through a terminal of a clamp. A thumb screw may be turned clockwise. A thumb screw may be turned counter-clockwise. A thumb screw may threadably extend through a terminal of a clamp. A thumb screw may be abutted against an outer surface of a drum hoop. A thumb screw may be threadably retracted through a terminal of a clamp.

The term "tubular" as used herein is defined any structure having an inner surface and an outer surface. A tubular may have an aperture disposed therethrough. Preferably, a tubular is cylindrical. However, any or all tubulars of an assembly, e.g., drum, drum hoop, or cord lock, may have polygonal cross-sections, e.g., triangular, rectangular, pentagonal, hexagonal, or octagonal.

The term "unitary" as used herein defined as having the nature, properties, or characteristics of a single unit. For example, a body and a terminal that are individual parts of a clamp may be unitary in the sense they are not separate but rather are formed, e.g., molded, 3D-printed, or carved, from a single piece of material, e.g., plastic, carbon fiber, metal, or wood.

The terms "upper," "lower," "top," "bottom" as used herein are relative terms describing the position of one object, thing, or point positioned in its intended useful position, relative to some other object, thing, or point also positioned in its intended useful position, when the objects, things, or points are compared to distance from the center of the earth. The term "upper" identifies any object or part of a particular object that is farther away from the center of the earth than some other object or part of that particular object, when the objects are positioned in their intended useful positions. The term "lower" identifies any object or part of a particular object that is closer to the center of the earth than some other object or part of that particular object, when the objects are positioned in their intended useful positions. For example, a drum may have an upper end and a lower end. Additionally, a cylindrical object, e.g., drum, drum hoop, thumb screw, or cord lock, may have an upper portion and a lower portion. The term "top" as used herein means in the highest position, e.g., farthest from the ground. The term "bottom" as used herein means in the lowest position, e.g., closest the ground. For example, a cylindrical object, e.g., drum, drum hoop, thumb screw, or cord lock, may have a top portion and a bottom portion.

3. Certain Specific Embodiments

The disclosure herein includes a drum coupling assembly, which drum coupling assembly may include: a drum having a drum hoop and a drumhead; a first clamp coupled to the drum hoop; a second clamp coupled to the drum hoop; and an elastic cord coupled to the first clamp and the second clamp, an elastic cord, wherein at least a portion of the elastic cord extends between the first clamp and the second clamp, and wherein at least a portion of the elastic cord is disposed between an edge of the drum hoop and the drumhead.

The disclosure herein includes a drum coupling assembly, which drum coupling assembly may include: a drum having a drum hoop and a drumhead; a first clamp coupled to the drum hoop; a second clamp coupled to the drum hoop; and an elastic cord coupled to the first clamp and the second clamp, wherein the first clamp and the second clamp may hold a portion of the elastic cord between an edge of the drum hoop and the drumhead.

The disclosure herein includes a drum coupling assembly, which drum coupling assembly may include: a first clamp capable of being coupled to a drum hoop of a drum; a second clamp capable of being coupled to the drum hoop; and an elastic cord coupled to the first clamp and the second clamp, wherein the first clamp and the second clamp may be capable holding a portion of the elastic cord in an opening of the drum hoop.

The disclosure herein includes a drum coupling assembly, which drum coupling assembly may include: a first clamp capable of being coupled to a drum hoop of a drum, the first clamp having an aperture; a second clamp capable of being coupled to the drum hoop, the second clamp having an aperture; and an elastic cord extending through the aperture of the first clamp and the aperture of the second clamp, wherein a portion of the elastic cord may be capable of being disposed within an opening of the drum hoop.

The disclosure herein includes a drum coupling assembly, which drum coupling assembly may include: a first clamp capable of being coupled to a drum hoop of a drum, the first clamp having a first terminal having an aperture; a second clamp capable of being coupled to the drum hoop, the second clamp having a second terminal having an aperture; and an elastic cord extending through the aperture of the first terminal and the aperture of the second terminal, wherein the first terminal and the second terminal are capable holding a portion of the elastic cord between an edge of the drum hoop and a drumhead of the drum.

The disclosure herein includes a drum coupling assembly, which drum coupling assembly may include: a first clamp capable of being coupled to a hoop of a drum, the first clamp having an aperture; a second clamp capable of being coupled to the hoop, the second clamp having an aperture; and an elastic cord extending through the aperture of the first clamp and the aperture of the second clamp.

The disclosure herein includes a drum coupling assembly, which drum coupling assembly may include: a first clamp capable of being coupled to a drum hoop of a drum; a second clamp capable of being coupled to the drum hoop; and an elastic cord coupled to the first clamp and the second clamp, wherein the first clamp and the second clamp may be capable of holding a portion of the elastic cord between an edge of the drum hoop and a drumhead of the drum.

The disclosure herein includes a method of coupling a drum coupling assembly to a drum, which method may include: coupling a first clamp to a drum hoop of a drum; coupling a second clamp to the drum hoop; extending an elastic cord across a drumhead of the drum; and holding, with the first clamp and the second clamp, a portion of the elastic cord in an opening of the drum hoop.

In any one of the methods or structures disclosed herein, the portion of the elastic cord extending between the first clamp and the second clamp extends from the first clamp and the second clamp.

In any one of the methods or structures disclosed herein, a first portion of the elastic cord is coupled to the first clamp and a second portion of the elastic cord is coupled to the second clamp.

In any one of the methods or structures disclosed herein, the first clamp and the second clamp hold a portion of the elastic cord within the drum hoop.

In any one of the methods or structures disclosed herein, at least a portion of the elastic cord is disposed parallel to the drumhead and is configured to be capable of restraining an object between the elastic cord and the drumhead.

In any one of the methods or structures disclosed herein, at least a portion of the elastic cord that extends between the first clamp and the second clamp is not in physical contact with the drumhead.

In any one of the methods or structures disclosed herein, at least a portion of the elastic cord that extends between the first clamp and the second clamp is disposed at least 1.0 millimeter away from the drumhead.

In any one of the methods or structures disclosed herein, the elastic cord extends through an aperture in the first clamp or the second clamp or both the first clamp and the second clamp.

In any one of the methods or structures disclosed herein, the first clamp or the second clamp or both the first clamp and the second clamp comprises a terminal having an aperture extending through the terminal, wherein a portion of the elastic cord extends through the aperture.

In any one of the methods or structures disclosed herein, the first clamp and the second clamp are capable of holding a portion of the elastic cord within the drum hoop.

In any one of the methods or structures disclosed herein, the drum coupling assembly may further include: a first cord lock coupled to a first portion of the cord and capable of being abutted against the first clamp; and a second cord lock coupled to a second portion of the cord and capable of being abutted against the second clamp.

In any one of the methods or structures disclosed herein, each clamp of the first clamp and the second clamp further comprises: a first terminal capable of being abutted against an inner surface of a drum hoop of the drum; a second terminal; and a thumb screw threadably extending through the second terminal.

In any one of the methods or structures disclosed herein, the thumb screw is capable of being abutted against an outer surface of the drum hoop of the drum.

In any one of the methods or structures disclosed herein, the first terminal and the second terminal may be capable of holding a portion of the elastic cord in an opening of the drum hoop.

In any one of the methods or structures disclosed herein, the elastic cord may further include a restraining portion that is capable of being disposed within a drum hoop of the drum.

In any one of the methods or structures disclosed herein, the elastic cord may further include a restraining portion that is capable of being disposed substantially parallel to a drumhead of the drum.

In any one of the methods or structures disclosed herein, the elastic cord may further include a restraining portion that is not in physical contact with the drum.

In any one of the methods or structures disclosed herein, the elastic cord may further include a restraining portion that is capable of being disposed at least 1.0 millimeter away from a drumhead of the drum.

In any one of the methods or structures disclosed herein, the elastic cord may be capable of being pushed or pulled substantially orthogonal to a drumhead of the drum.

In any one of the methods or structures disclosed herein, the elastic cord may extend through the first clamp and the second clamp.

In any one of the methods or structures disclosed herein, the elastic cord may have a portion that is tied into a knot.

In any one of the methods or structures disclosed herein, the elastic cord may be capable of ingress or egress, or both, through the first clamp and the second clamp.

In any one of the methods or structures disclosed herein, the drum coupling assembly may further include a cord lock coupled to a portion of the elastic cord.

In any one of the methods or structures disclosed herein, each clamp of the first clamp and the second clamp may further include a terminal having an aperture extending through the terminal, wherein the elastic cord may extend through the aperture of each clamp of the first clamp and the second clamp.

In any one of the methods or structures disclosed herein, each clamp of the first clamp and the second clamp may further include: a terminal having an aperture extending therethrough, wherein the elastic cord may extend through the aperture of the terminal.

In any one of the methods or structures disclosed herein, each clamp of the first clamp and the second clamp may further include: a body having an aperture extending therethrough; and a terminal extending from the body, the terminal having an aperture extending laterally through an end of the terminal, wherein the elastic cord may extend through the aperture of the terminal and the aperture of the body.

In any one of the methods or structures disclosed herein, each clamp of the first clamp and the second clamp further comprises: a first aperture; and a second aperture, wherein the elastic cord extends through the first aperture in a first direction and the second aperture in a second direction.

In any one of the methods or structures disclosed herein, each clamp of the first clamp and the second clamp may further include: a first terminal capable of being abutted against an inner surface of a drum hoop of the drum; a second terminal; and a thumb screw threadably extending through the second terminal.

In any one of the methods or structures disclosed herein, the drum coupling assembly may further include a cord lock coupled to a portion of the elastic cord, wherein the cord lock may be capable of being abutted against a clamp.

Any one of the methods disclosed herein may further include coupling a percussive effects object to the elastic cord and the drumhead.

Any one of the methods disclosed herein may further include resiliently deforming a restraining portion of the elastic cord.

Any one of the methods disclosed herein may further include: pulling a portion of the elastic cord through a clamp; and tying an end portion of the elastic cord into a knot.

Any one of the methods disclosed herein may further include: pulling the elastic cord through a clamp; and sliding a cord lock away or towards the clamp.

Any one of the methods disclosed herein may further include: uncoupling a cord lock from the elastic cord; pulling the elastic cord through a clamp and the cord lock; and coupling the cord lock to the elastic cord.

4. Specific Embodiments in the Drawings

The drawings presented herein are for illustrative purposes only and do not limit the scope of the claims. Rather, the drawings are intended to help enable one having ordinary skill in the art to make and use the claimed inventions.

This section addresses specific versions of drum coupling assemblies shown in the drawings, which relate to assemblies, elements and parts that can be part of a drum coupling assembly, and methods for coupling a cord to a drum. Although this section focuses on the drawings herein, and the specific embodiments found in those drawings, parts of this section may also have applicability to other embodiments not shown in the drawings. The limitations referenced in this section should not be used to limit the scope of the claims themselves, which have broader applicability.

Although the methods, structures, elements, and parts described herein have been described in detail, it should be understood that various changes, substitutions, and alterations can be made without departing from the spirit and scope of the inventions as defined by the following claims. Those skilled in the art may be able to study the preferred embodiments and identify other ways to practice the inventions that are not exactly as described herein. It is the intent of the inventor that variations and equivalents of the inventions are within the scope of the claims, while the description, abstract and drawings are not to be used to limit the scope of the inventions. The inventions are specifically intended to be as broad as the claims below and their equivalents.

FIGS. 5, 8, 10, 13, 19, 22, 24, and 27 illustrate top plan and perspective views of exemplary drum coupling assemblies 100 that may include drums 200, first clamps 102*a*, second clamps 102*b*, and cords 104. Like elements may be indicated by like reference numerals.

Referring to FIGS. 5, 8, 10, 13, 19, 22, 24, and 27, a drum 200 may include a drum hoop 202 and a drumhead 204. A first clamp 102*a*, a second clamp 102*b*, and a cord 104 may be coupled to drum 200. Preferably, the cord 104 is constructed of resilient and/or elastic material, e.g., elastomer, plastic, latex, rubber, nitrile rubber, butyl rubber, silicone, and/or neoprene. The cord 104 may have a first end coupled to the first clamp 102*a*. Also, the cord 104 may have a second end coupled to the second clamp 102*b*. The first clamp 102*a* may be removably coupled to a first portion of the drum hoop 202. The second clamp 102*b* may be removably coupled to a second portion of the drum hoop 202. Furthermore, the cord 104 may have a restraining portion 106 defined between the first clamp 102*a* and the second clamp 102*b*. The restraining portion 106 may extend or stretch across the drumhead 204.

FIGS. 7, 12, 21, and 26 illustrate cross-sectional side views of exemplary drum coupling assemblies 100 that may include drums 200, first clamps 102*a*, second clamps 102*b*, and cords 104. Like elements may be indicated by like reference numerals.

Referring to FIGS. 7, 12, 21, and 26, a drum 200 may include a drum hoop 202 and a drumhead 204. A first clamp 102*a*, a second clamp 102*b*, and a cord 104 may be coupled to drum 200. The cord 104 may have a first end coupled to the first clamp 102*a*. Also, the cord 104 may have a second end coupled to the second clamp 102*b*. The cord 104 may have a restraining portion 106 defined between the first clamp 102*a* and the second clamp 102*b*. Preferably, the restraining portion 106 is not in physical contact with the drumhead 204. The restraining portion 106 may be substantially parallel to the drumhead 204. Also, the restraining portion 106 may be disposed within an opening of the drum hoop 202. Therefore, when coupled to the drum hoop 202, the restraining portion 106 would be disposed between an upper edge of the drum hoop 202 and the drumhead 204. In other words, the distance between the top-most edge of the drum hoop 202 and the drumhead 204 may be greater than the distance between the cord 104 and the drumhead 204.

FIGS. 6, 9, 20, and 23 illustrate perspective and side views of exemplary clamps 102 coupled to drum hoops 202 having flanges 312. Like elements may be indicated by like reference numerals.

Referring to FIGS. 6, 9, 20, and 23, a clamp 102 may have a body 302, a first terminal 304*a*, a second terminal 304*b*, and a thumb screw 306. The body 302, the first terminal 304*a*, and the second terminal 304*b* may be unitary. The first terminal 304*a* and the second terminal 304*b* may each extend from the body 302. The terminals 304*a*, 304*b* may extend from opposite ends of the body 302. Thus, the body 302, the first terminal 304*a*, and the second terminal 304*b* may form the shape of a block-letter "C."

The terminals 304*a*, 304*b* may be spaced apart such that a flange 312 of a drum hoop 202 may be disposed between the terminals 304*a*, 304*b*. Accordingly, the first terminal 304*a* may be adjacent an inner surface of the drum hoop 202. Moreover, the first terminal 304*a* may be abutted against and/or in physical contact with the inner surface of the drum hoop 202. In addition, the second terminal 304*b* may be adjacent an outer surface of the drum hoop 202. Also, the body 302 may be adjacent and/or above the flange 312.

Additionally, the thumb screw 306 may threadably extend through the second terminal 304*b*. Furthermore, the thumb screw 306 may be abutted against and/or in physical contact with an outer surface of the drum hoop 202.

Figure 6:
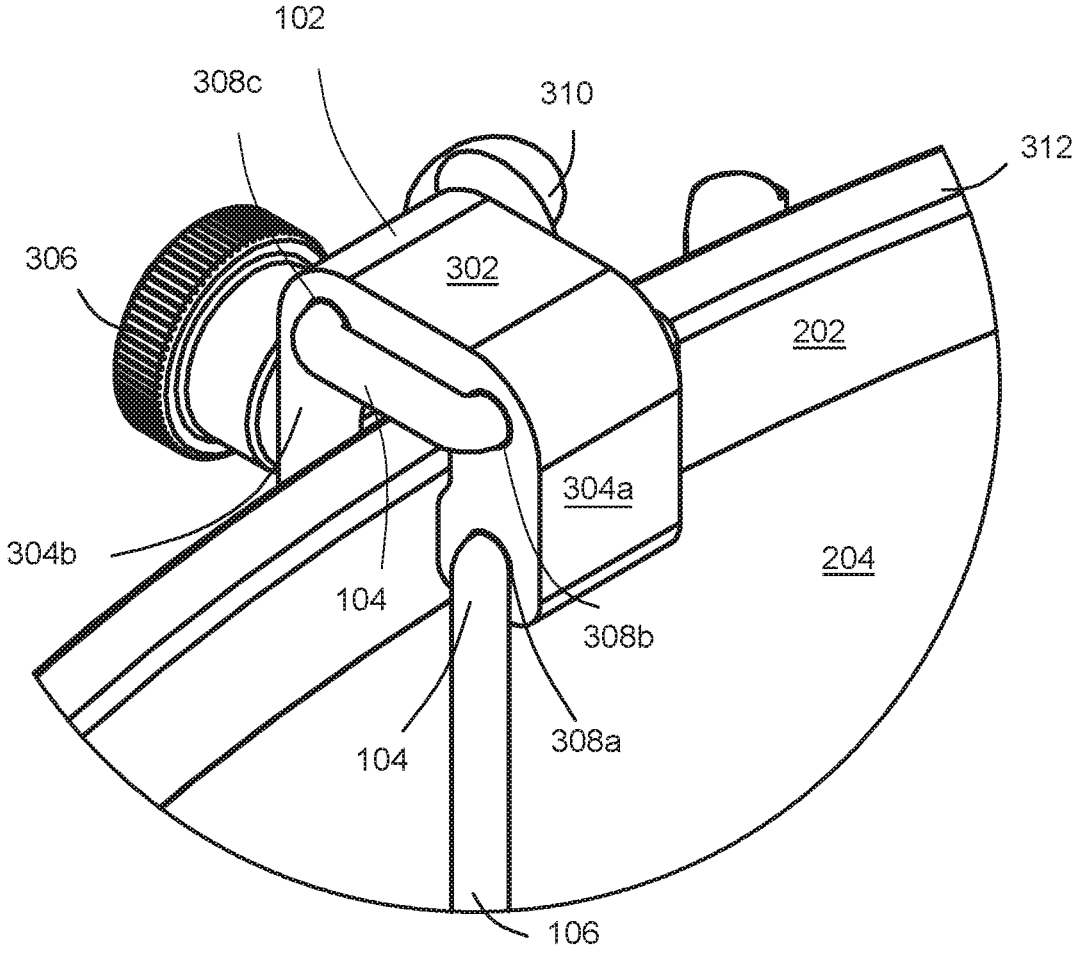
FIG. 6 illustrates a perspective view of a clamp coupled to a drum hoop of a drum and a cord coupled to the clamp, the clamp having three apertures disposed therein.
Figure 7:
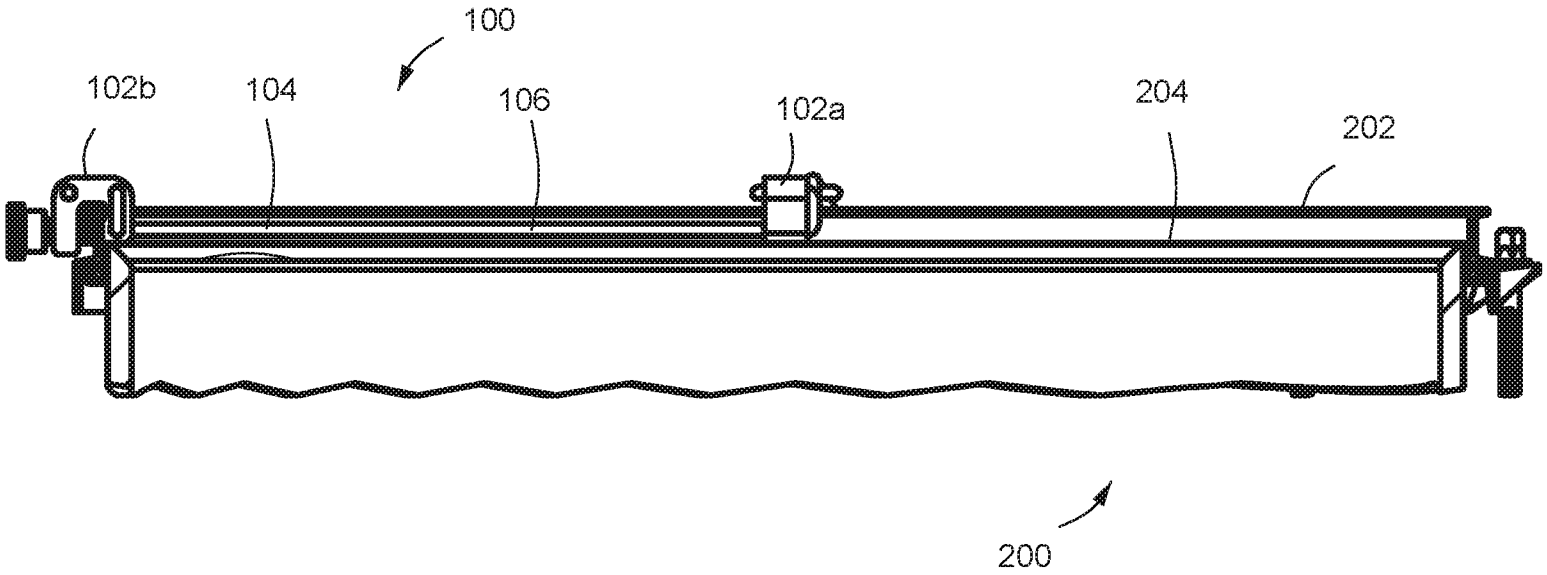
FIG. 7 illustrates a cross-sectional side view of a drum having two clamps coupled to a drum hoop of the drum.
Figure 8:
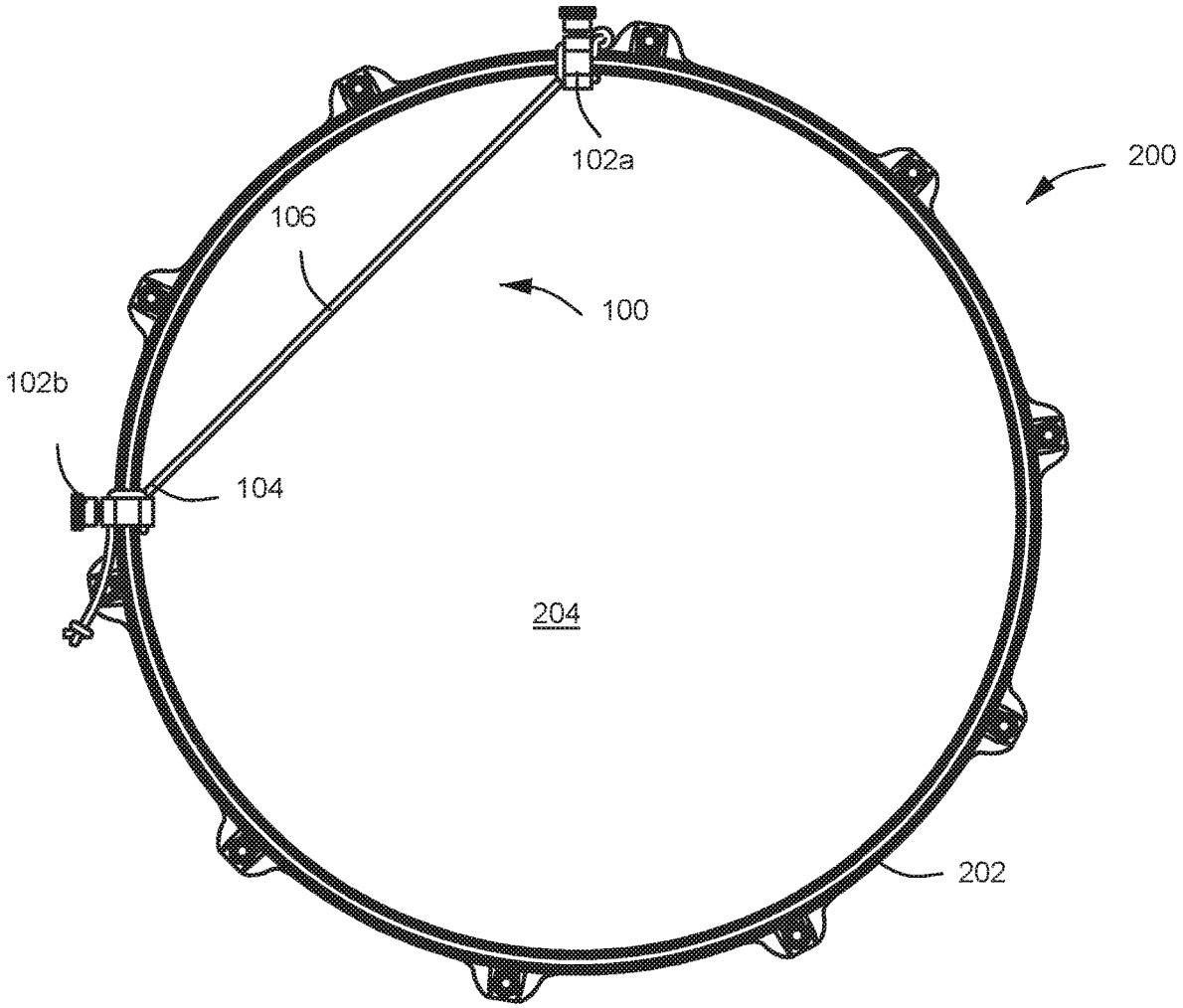
FIG. 8 illustrates a top plan view of a drum coupling assembly including a drum and a cord having a restraining portion extending across a drumhead of the drum.
Figure 9:
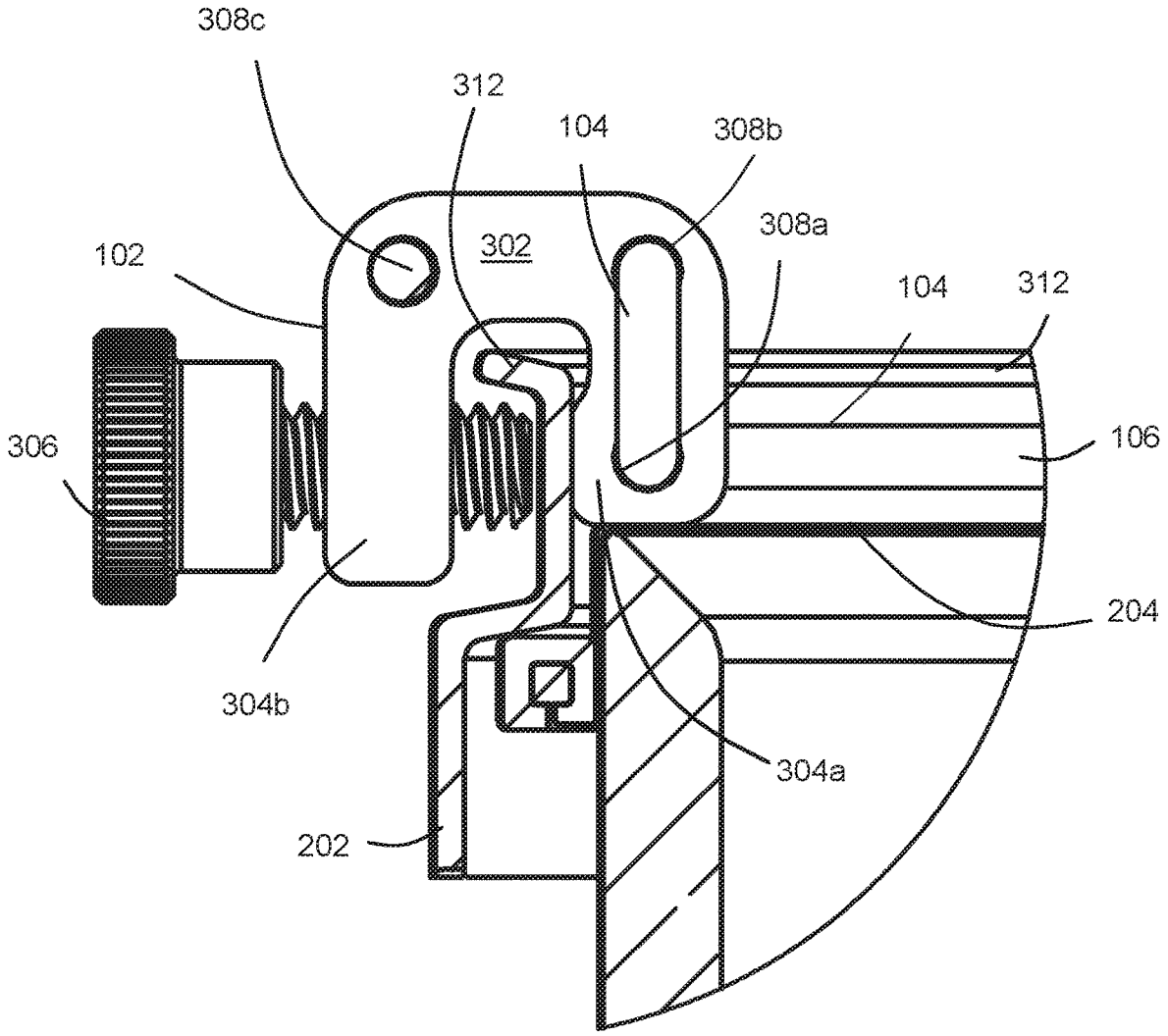
FIG. 9 illustrates a close-up cross-sectional side view of a clamp coupled to a drum hoop having a flange, the clamp having three apertures disposed therein.
Figure 10:
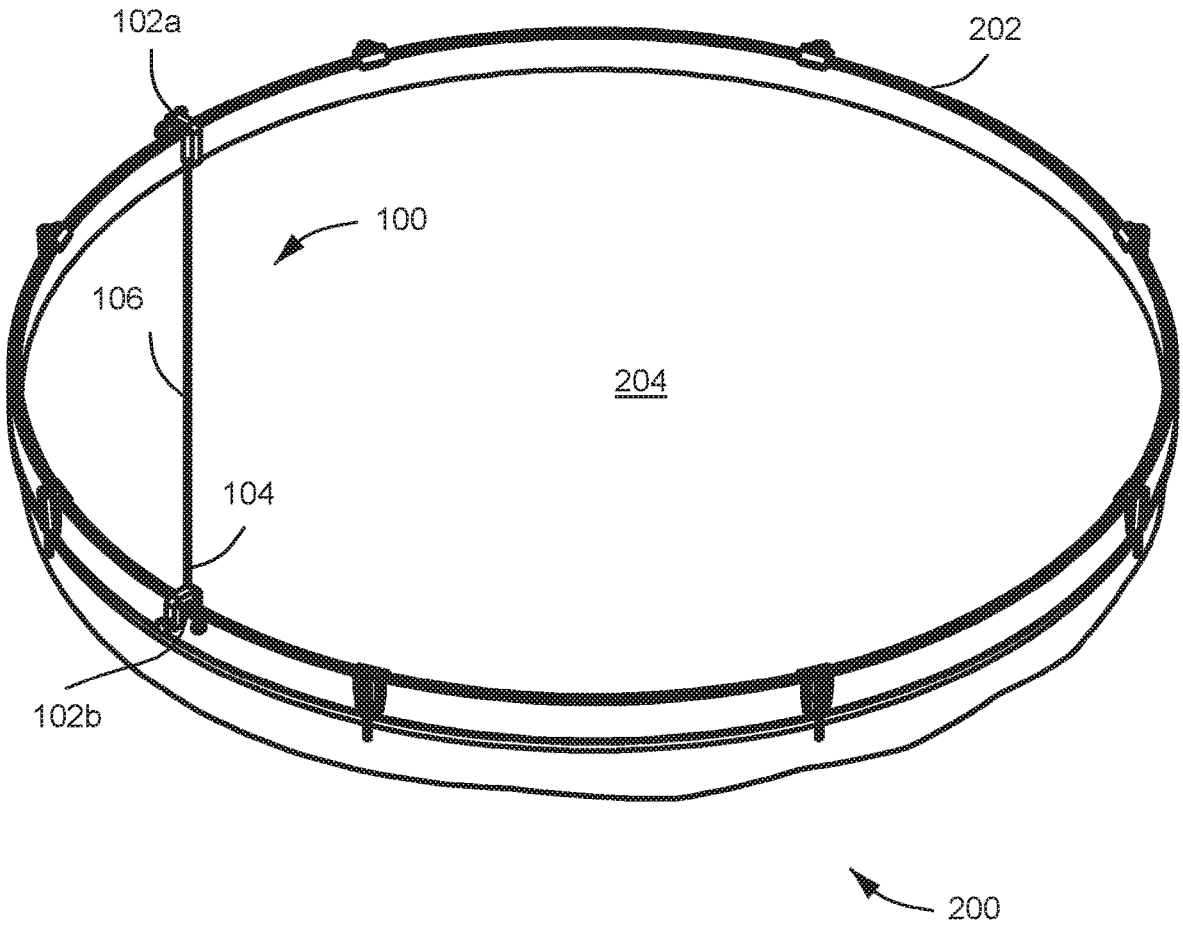
FIG. 10 illustrates a perspective view of a drum coupling assembly including a drum and a cord having a restraining portion extending across a drumhead of the drum.

Referring to FIG. 6 and FIG. 9, a first aperture 308*a* may be disposed laterally through the first terminal 304*a*. Preferably, the first aperture 308*a* is disposed at a lower end of the first terminal 304*a*. Correspondingly, the first aperture 308*a* may be disposed proximate a drumhead 204. A second aperture 308*b* may be disposed laterally through the body 302. A third aperture 308*c* may also be disposed laterally through the body 302.

The apertures 308*a-c* may each receive a portion of a cord 104. The cord 104 may extend through the first aperture 308*a* and the third aperture 308*c* in a first direction and may extend through the second aperture 308*b* in a second, e.g., opposite, direction.

Figure 20:
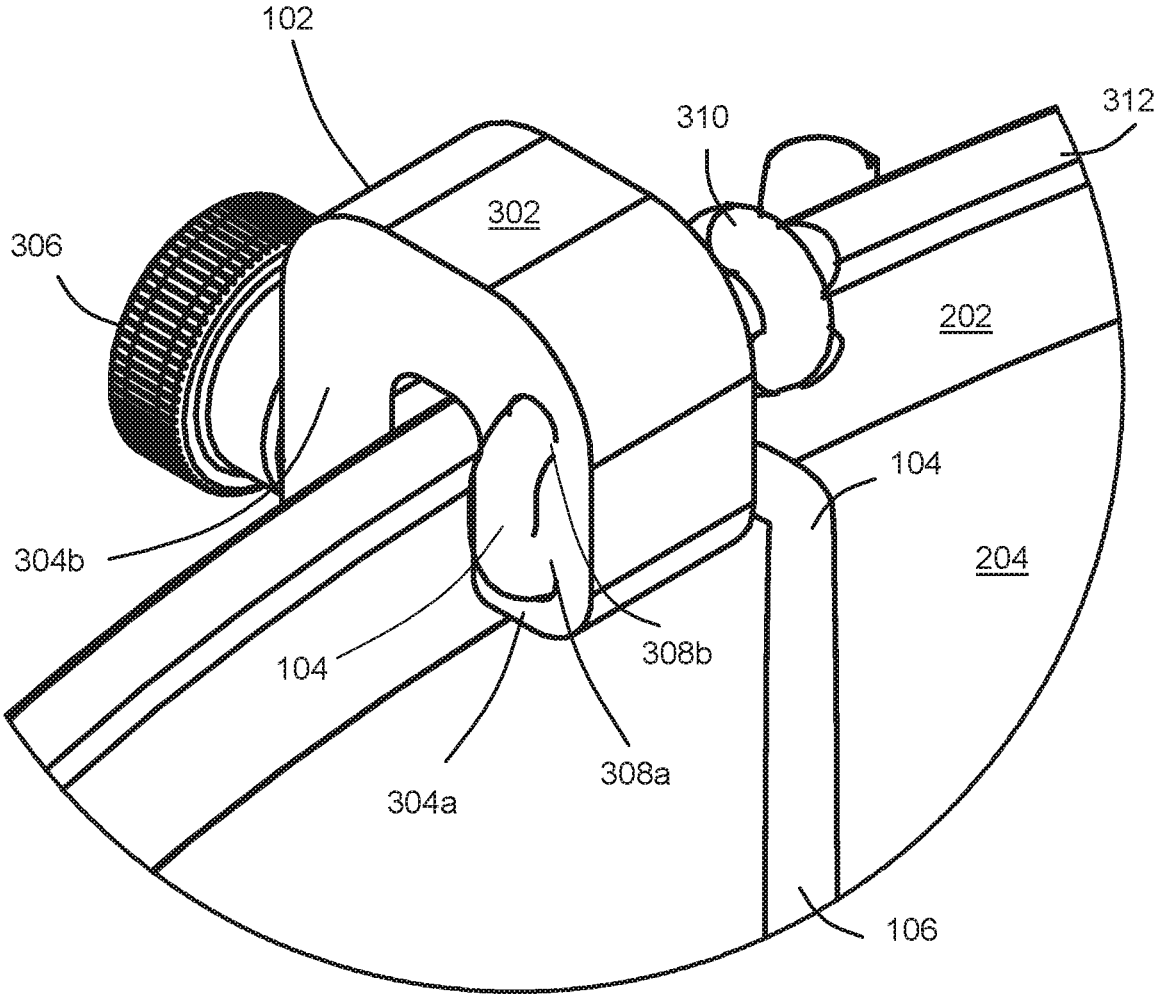
FIG. 20 illustrates a perspective view of a clamp coupled to a drum hoop of a drum and a cord coupled to the clamp, the clamp having two apertures disposed therein.
Figure 23:
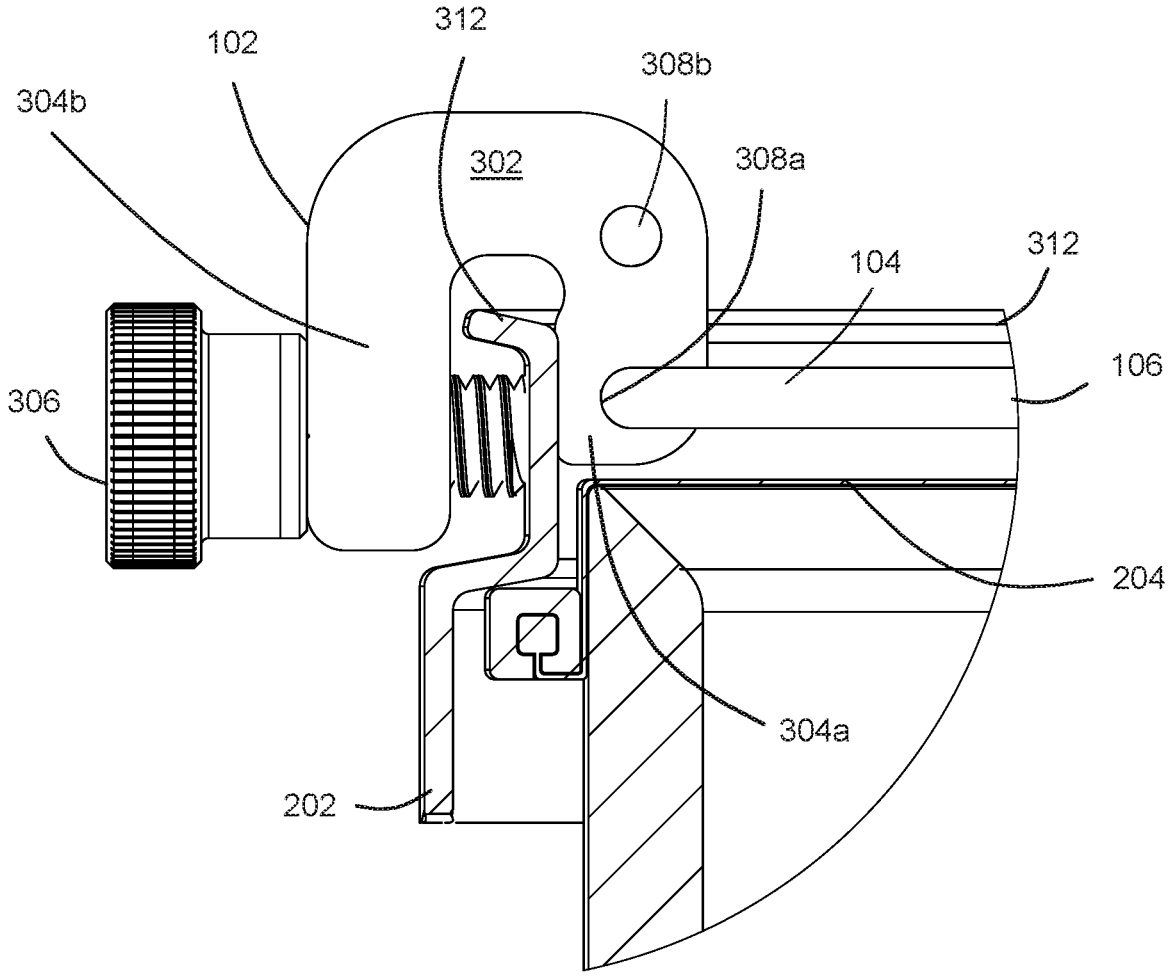
FIG. 23 illustrates a side view of a clamp coupled to a drum hoop having a flange, the clamp having two apertures disposed therein.

Referring to FIG. 20 and FIG. 23, a first aperture 308*a* may be disposed laterally through the first terminal 304*a*. Preferably, the first aperture 308*a* is disposed at a lower end of the first terminal 304*a*. Correspondingly, the first aperture 308*a* may be disposed proximate the drumhead 204. A second aperture 308*b* may be disposed laterally through the body 302.

The apertures 308*a-b* may each receive a portion of a cord 104. The cord 104 may extend through the first aperture 308*a* in a first direction and may extend through the second aperture 308*b* in a second, e.g., opposite, direction.

FIGS. 11, 14, 25, and 28 illustrate perspective and side views of clamps 102 coupled to drum hoops 202. Like elements may be indicated by like reference numerals.

Referring to FIGS. 11, 14, 25, and 28, a clamp 102 may have a body 302, a first terminal 304*a*, a second terminal 304*b*, and a thumb screw 306. The body 302, the first terminal 304*a*, and the second terminal 304*b* may be unitary. In addition, the clamp may include a thumb screw 306. The first terminal 304*a* and the second terminal 304*b* may each extend from the body 302. The terminals 304*a*, 304*b* may extend from opposite ends of the body 302. Thus, the body 302, the first terminal 304*a*, and the second terminal 304*b* may form the shape of a block-letter "C."

The terminals 304*a*, 304*b* may be spaced apart such that a portion of a drum hoop 202 may be disposed between the terminals 304*a*, 304*b*. Accordingly, the first terminal 304*a* may be adjacent an inner surface of the drum hoop 202. Moreover, the first terminal 304*a* may be abutted against and/or in physical contact with the inner surface of the drum hoop 202. In addition, the second terminal 304*b* may be adjacent an outer surface of the drum hoop 202. Also, the body 302 may be adjacent and/or over an edge of the drum hoop 202. Additionally, the thumb screw 306 may threadably extend through the second terminal 304*b*. Furthermore, the thumb screw 306 may be abutted against and/or in physical contact with an outer surface of the drum hoop 202.

Figure 11:
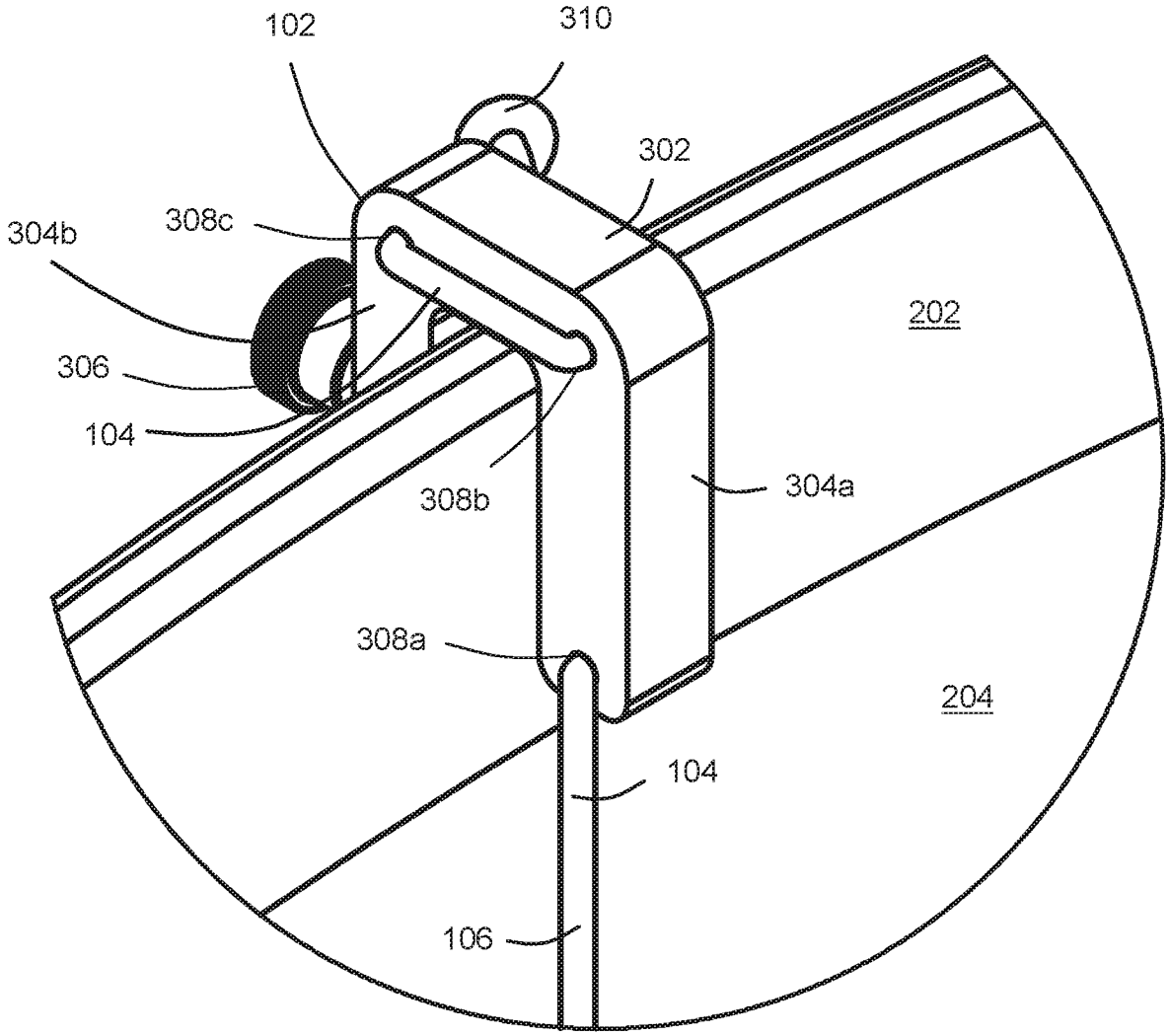
FIG. 11 illustrates a perspective view of a clamp coupled to a drum hoop of a drum, the clamp having three apertures disposed therein.
Figure 12:
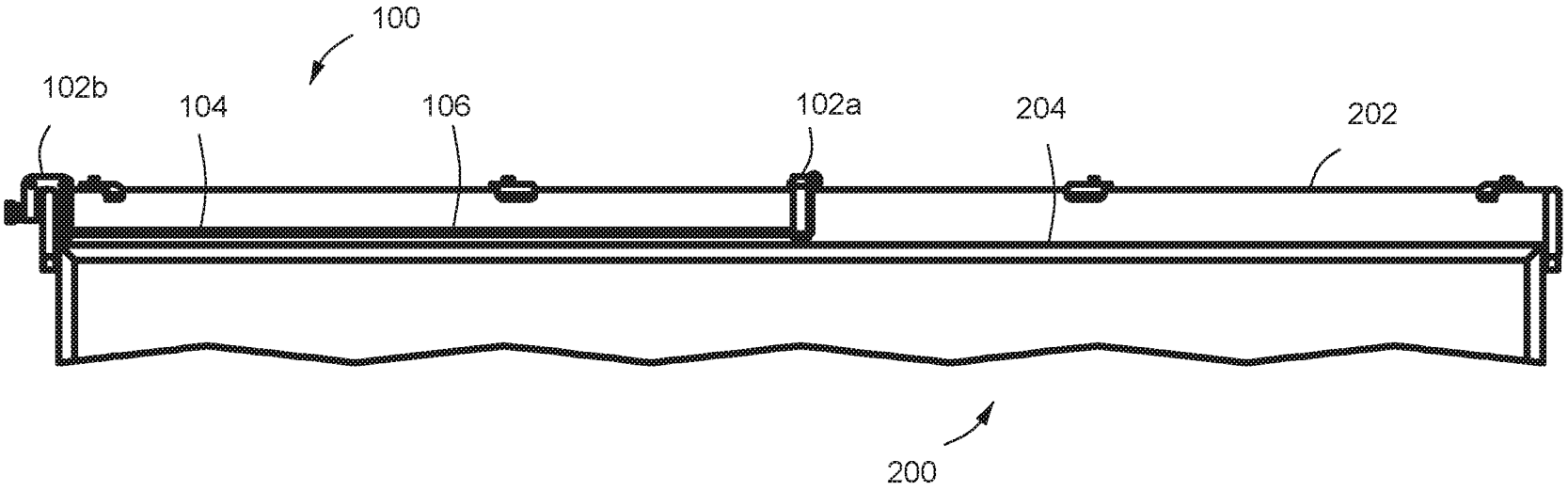
FIG. 12 illustrates a cross-sectional side view of a view of a drum having two clamps coupled to a drum hoop of the drum.
Figure 13:
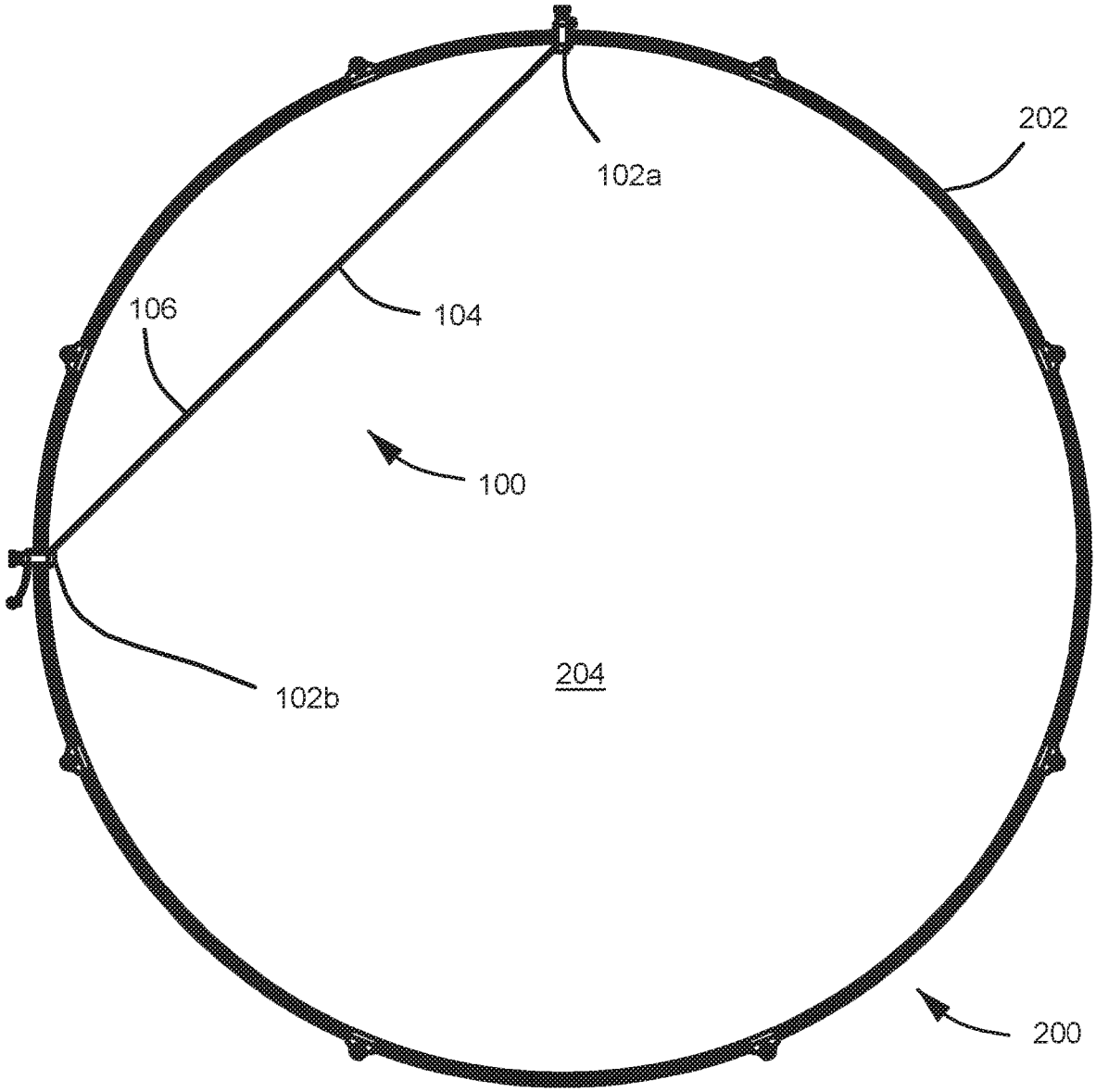
FIG. 13 illustrates a top plan view of a drum coupling assembly including a drum and a cord having a restraining portion extending across a drumhead of the drum.
Figure 14:
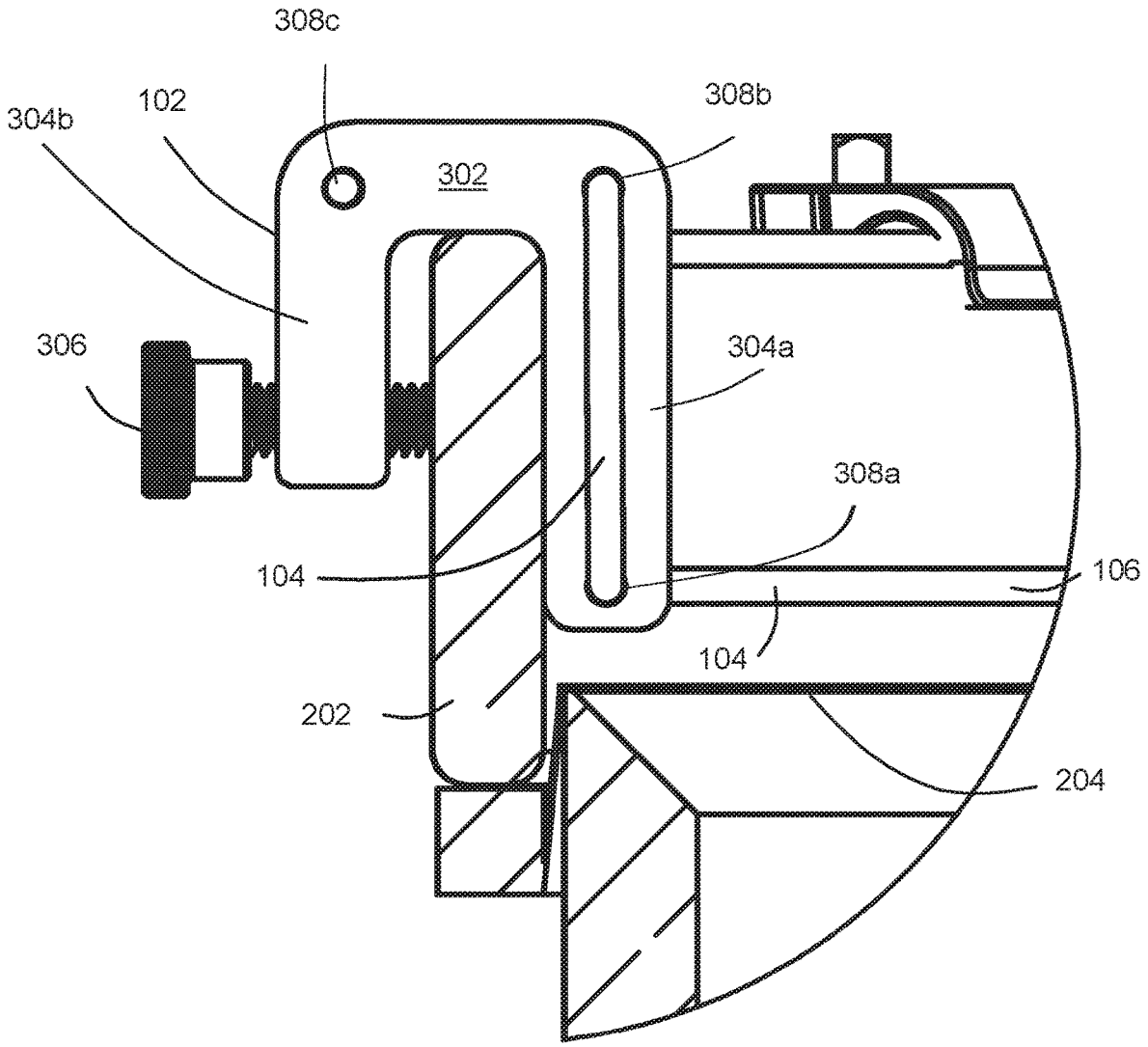
FIG. 14 illustrates a close-up cross-sectional side view of a clamp coupled to a drum hoop of a drum, the clamp having three apertures disposed therein.

Referring to FIG. 11 and FIG. 14, a first aperture 308*a* may be disposed laterally through the first terminal 304*a*. Preferably, the first aperture 308*a* is disposed at a lower end of the first terminal 304*a*. Correspondingly, the first aperture 308*a* may be disposed proximate a drumhead 204. A second aperture 308*b* may be disposed laterally through the body 302. A third aperture 308*c* may also be disposed laterally through the body 302.

The apertures 308*a-c* may each receive a portion of a cord 104. The cord 104 may extend through the first aperture 308*a* and third aperture 308*c* in a first direction and may extend through the second aperture 308*b* in a second, e.g., opposite, direction.

Figure 25:
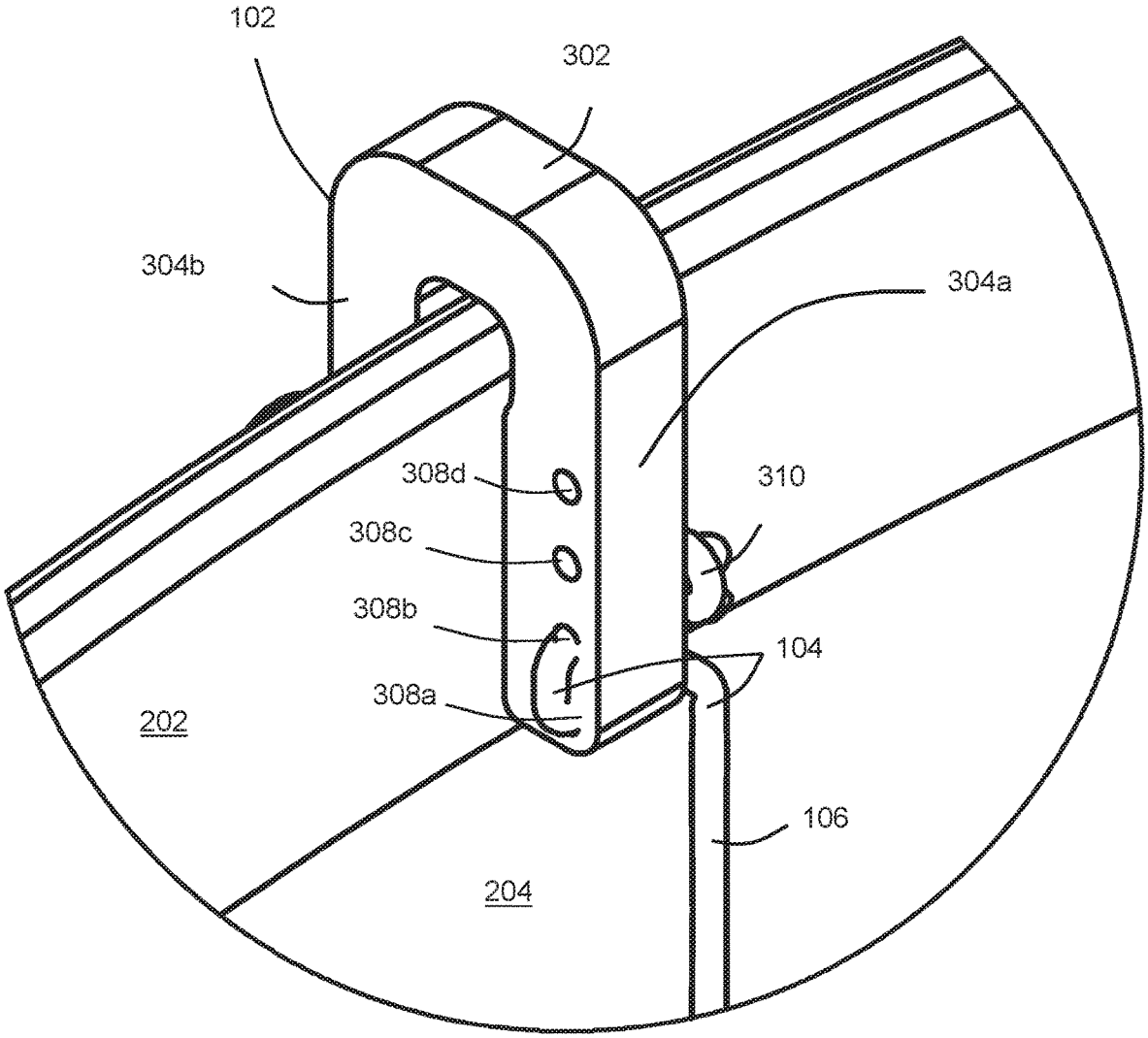
FIG. 25 illustrates a perspective view of a clamp coupled to a drum hoop of a drum, the clamp having four apertures disposed therein.
Figure 28:
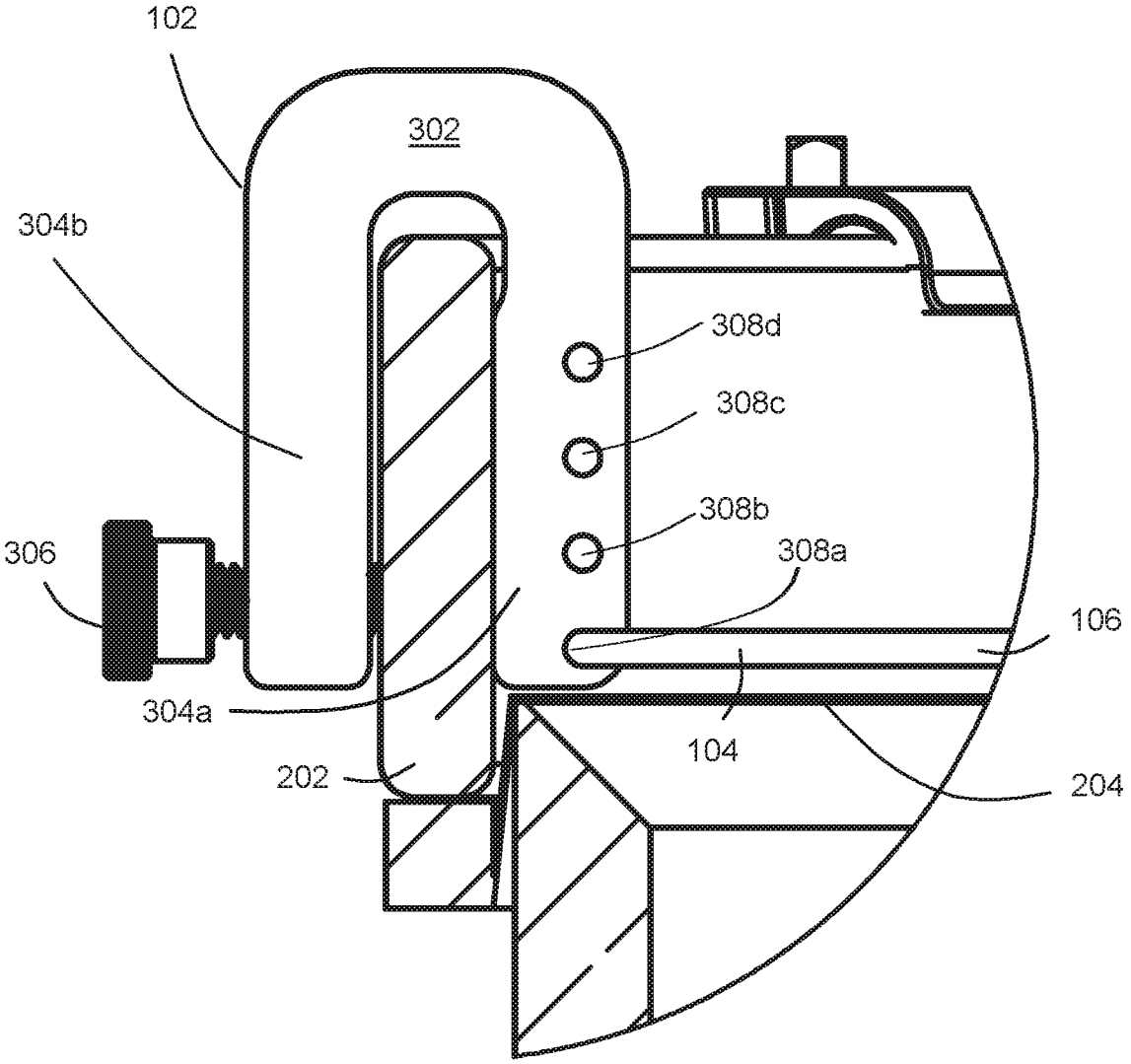
FIG. 28 illustrates a side view of a clamp coupled to a drum hoop of a drum, the clamp having four apertures disposed therein.

Referring to FIG. 25 and FIG. 28, apertures 308*a-d* may be disposed laterally through the first terminal 304*a*. Preferably, the apertures 308*a-d* is disposed at a lower end of the first terminal 304*a*. Correspondingly, the first aperture 308*a* of the first terminal 304*a* may be disposed proximate the drumhead 204. Aperture 308*b-d* may also be disposed laterally through the first terminal 304*a*.

The apertures 308*a-b* may each receive a portion of a cord 104. The cord 104 may extend through the first aperture 308*a* in a first direction and may extend through the second aperture 308*b* in a second, e.g., opposite, direction (FIG. 25). Although not shown, the cord 104 may also extend through the apertures 308*c*, 308*d*.

FIGS. 1, 2, 15, and 16 illustrate perspective views of exemplary drum coupling assemblies 100 that include clamps 102 configured for coupling to drum hoops 202 having flanges 312. Like elements may be indicated by like reference numerals.

Referring to FIGS. 1, 2, 15, and 16, a drum coupling assembly 100 may include a first clamp 102*a*, a second clamp 102*b*, and a cord 104. The first clamp 102*a* may have a body 302*a*, a first terminal 304*a*, a second terminal 304*b*, and a thumb screw 306*a*. The first terminal 304*a* and the second terminal 304*b* may each extend from the body 302*a*. The thumb screw 306*a* may threadably extend through the second terminal 304*b*.

In addition, the second clamp 102*b* may have a body 302*b*, a first terminal 304*c*, a second terminal 304*d*, and a thumb screw 306*b*. The first terminal 304*c* and the second terminal 304*d* may each extend from the body 302*b*. The thumb screw 306*b* may threadably extend through the second terminal 304*d*.

Furthermore, the cord 104 may have a first end portion slidably coupled to the first clamp 102*a*. The first end portion of the cord 104 may extend through apertures 308*a-c* disposed in the first clamp 102*a*. Also, the cord 104 may have a second end portion slidably coupled to the second clamp 102*b*. The second end portion of the cord 104 may extend through apertures 308*d-f* disposed in the second clamp 102*b*. A restraining portion 106 of the cord 104 may be defined between the clamps 102*a*, 102*b*.

Figure 2:
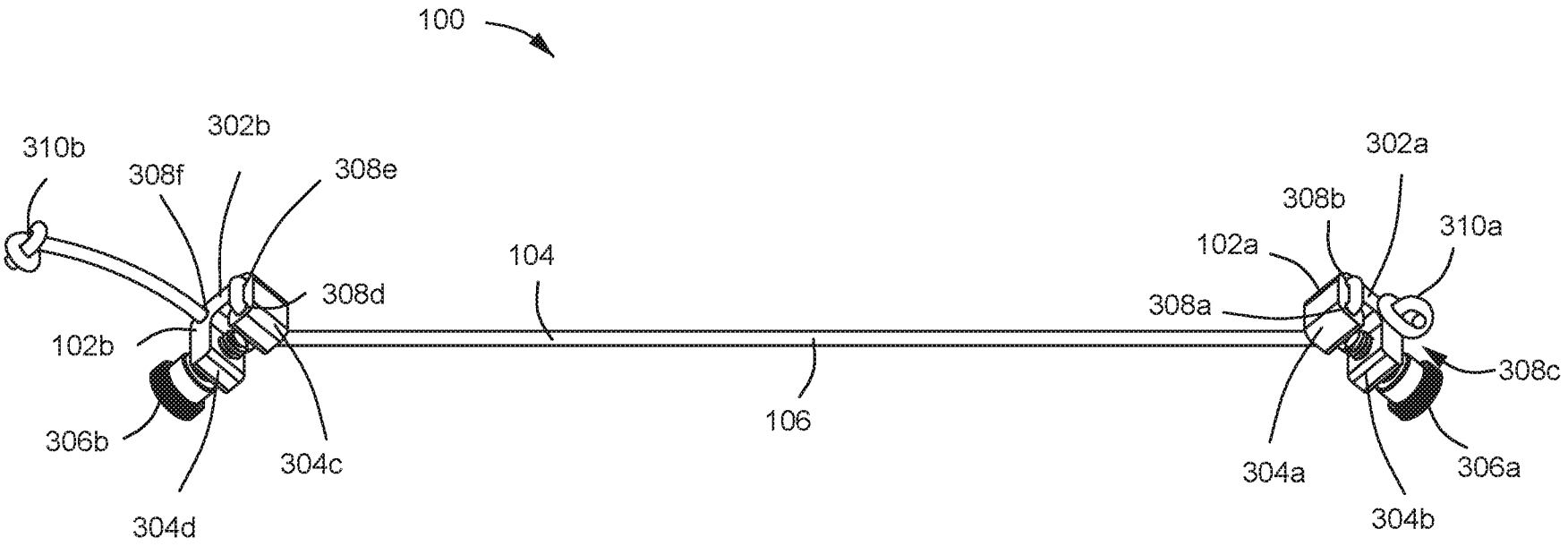
FIG. 2 illustrates a worms-eye perspective view of a drum coupling assembly including two clamps, in which each clamp has three apertures disposed therein, and a cord coupled to the two clamps.

Referring to FIG. 1 and FIG. 2, first apertures 308*a*, 308*d* may be disposed laterally through the first terminals 304*a*, 304*c* of the clamps 102*a*, 102*b*, respectively. Preferably, the first apertures 308*a*, 308*d* are disposed at a lower end of the respective first terminals 304*a*, 304*c*. Second apertures 308*b*, 308*e* may be disposed laterally through the bodies 302*a*, 302*b*, respectively. Third aperture 308*c*, 308*f* may also be disposed laterally through the bodies 302*a*, 302*b*, respectively.

The apertures 308*a-f* may each receive a portion of the cord 104. Through the first clamp 102*a*, the cord 104 may extend through the first apertures 308*a* and third aperture 308*c* in a first direction and may extend through the second aperture 308*b* in a second, e.g., opposite, direction. Through the second clamp 102*b*, the cord 104 may extend through the first apertures 308*d* and third aperture 308*f* in a first direction and may extend through the second aperture 308*e* in a second, e.g., opposite, direction.

Figure 15:
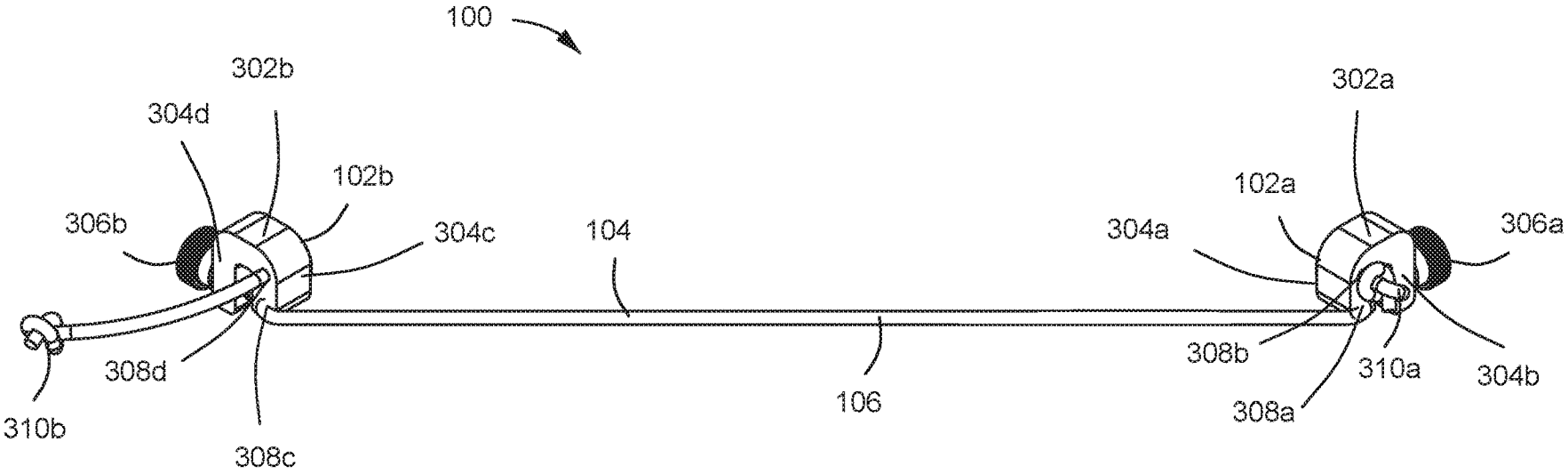
FIG. 15 illustrates a perspective view of a drum coupling assembly including two clamps, in which each clamp has two apertures disposed therein, and a cord coupled to the two clamps.
Figure 16:
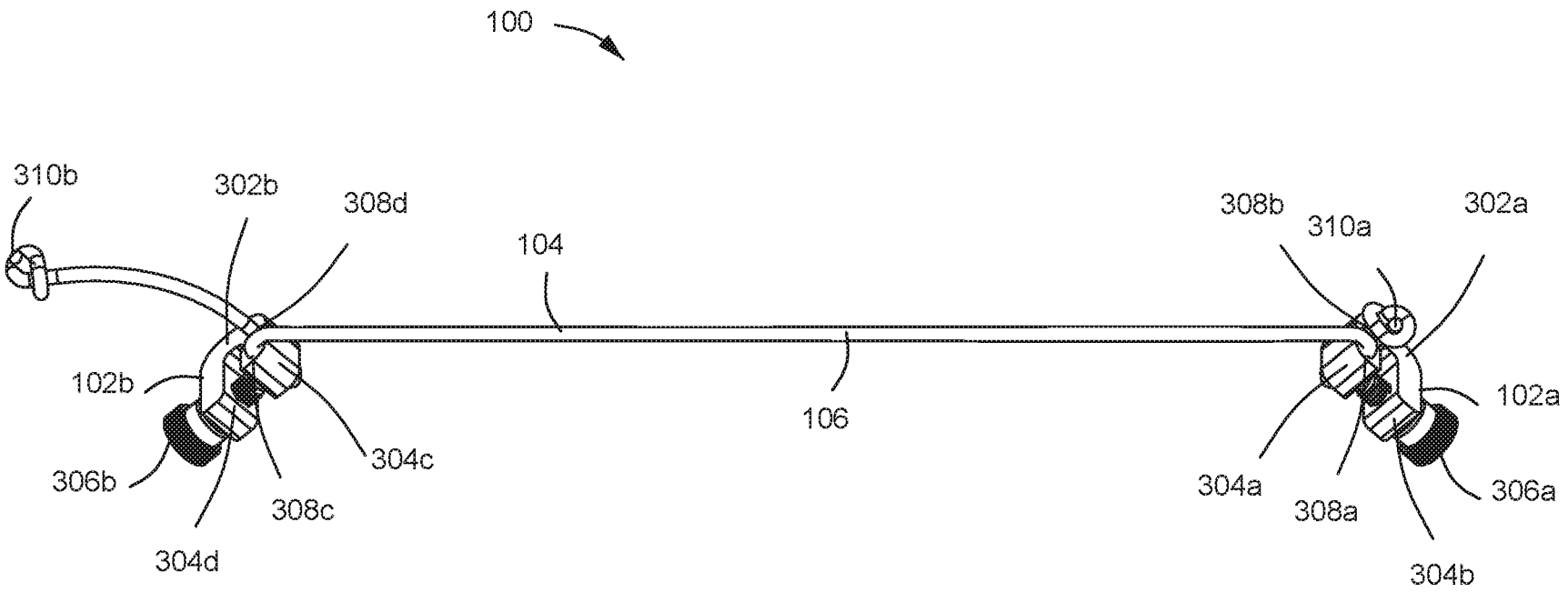
FIG. 16 illustrates a worms-eye perspective view of a drum coupling assembly including two clamps, in which each clamp has two apertures disposed therein, and a cord coupled to the two clamps.

Referring to FIG. 15 and FIG. 16, first apertures 308*a*, 308*c* may be disposed laterally through the first terminals 304*a*, 304*c* of the clamps 102*a*, 102*b*, respectively. Preferably, the first apertures 308*a*, 308*c* are disposed at a lower end of the respective first terminals 304*a*, 304*c*. Second apertures 308*b*, 308*d* may be disposed laterally through the bodies 302*a*, 302*b*, respectively.

The apertures 308*a-d* may each receive a portion of the cord 104. Through the first clamp 102*a*, the cord 104 may extend through the first apertures 308*a* in a first direction and may extend through the second aperture 308*b* in a second, e.g., opposite, direction. Through the second clamp 102*b*, the cord 104 may extend through the first apertures 308*c* in a first direction and may extend through the second aperture 308*d* in a second, e.g., opposite, direction.

FIGS. 3, 4, 17, and 18 illustrate perspective and side views of exemplary drum coupling assemblies 100. Like elements may be indicated by like reference numerals.

Referring to FIGS. 3, 4, 17, and 18, a drum coupling assembly 100 may include a first clamp 102*a*, a second clamp 102*b*, and a cord 104. The first clamp 102*a* may have a body 302*a*, a first terminal 304*a*, a second terminal 304*b*, and a thumb screw 306*a*. The first terminal 304*a* and the second terminal 304*b* may each extend from the body 302*a*. The thumb screw 306*a* may threadably extend through the second terminal 304*b*.

In addition, the second clamp 102*b* may have a body 302*b*, a first terminal 304*c*, a second terminal 304*d*, and a thumb screw 306*b*. The first terminal 304*c* and the second terminal 304*d* may each extend from the body 302*b*. The thumb screw 306*b* may threadably extend through the second terminal 304*d*.

Furthermore, the cord 104 may have a first end portion slidably coupled to the clamp 102*a*. The first end portion of the cord 104 may extend through apertures 308*a-c* disposed in the first clamp 102*a*. Also, the cord 104 may have a second end portion slidably coupled to the clamp 102*b*. The second end portion of the cord 104 may extend through apertures 308*d-f* disposed in the second clamp 102*b*. A restraining portion 106 of the cord 104 may be defined between the clamps 102*a*, 102*b*.

Figure 3:
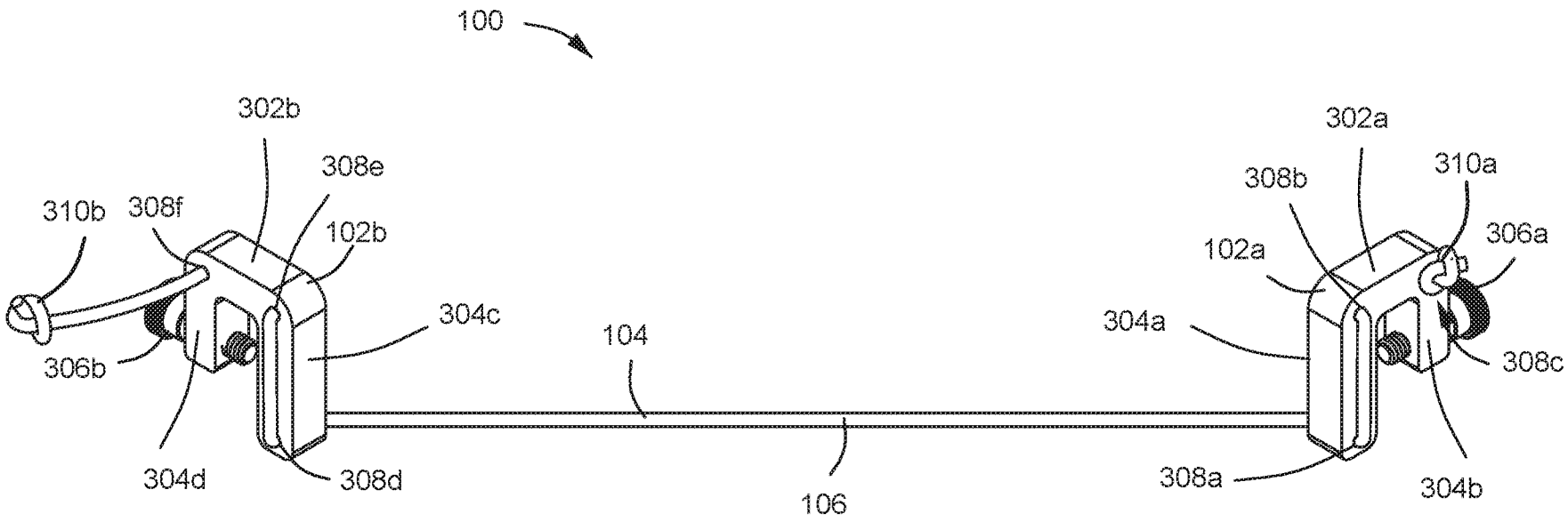
FIG. 3 illustrates a perspective view of a drum coupling assembly including two clamps, in which each clamp has three apertures disposed therein, and a cord coupled to the two clamps.
Figure 4:
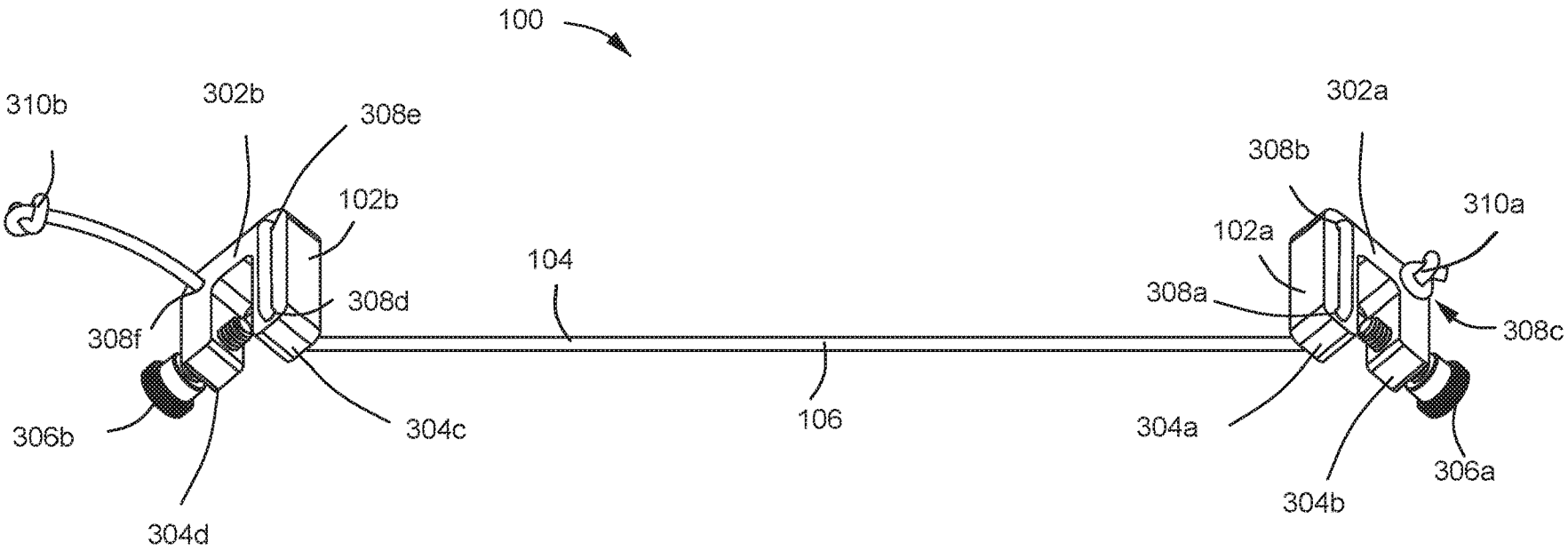
FIG. 4 illustrates a worms-eye perspective view of a drum coupling assembly including two clamps, in which each clamp has three apertures disposed therein, and a cord coupled to the two clamps.
Figure 5:
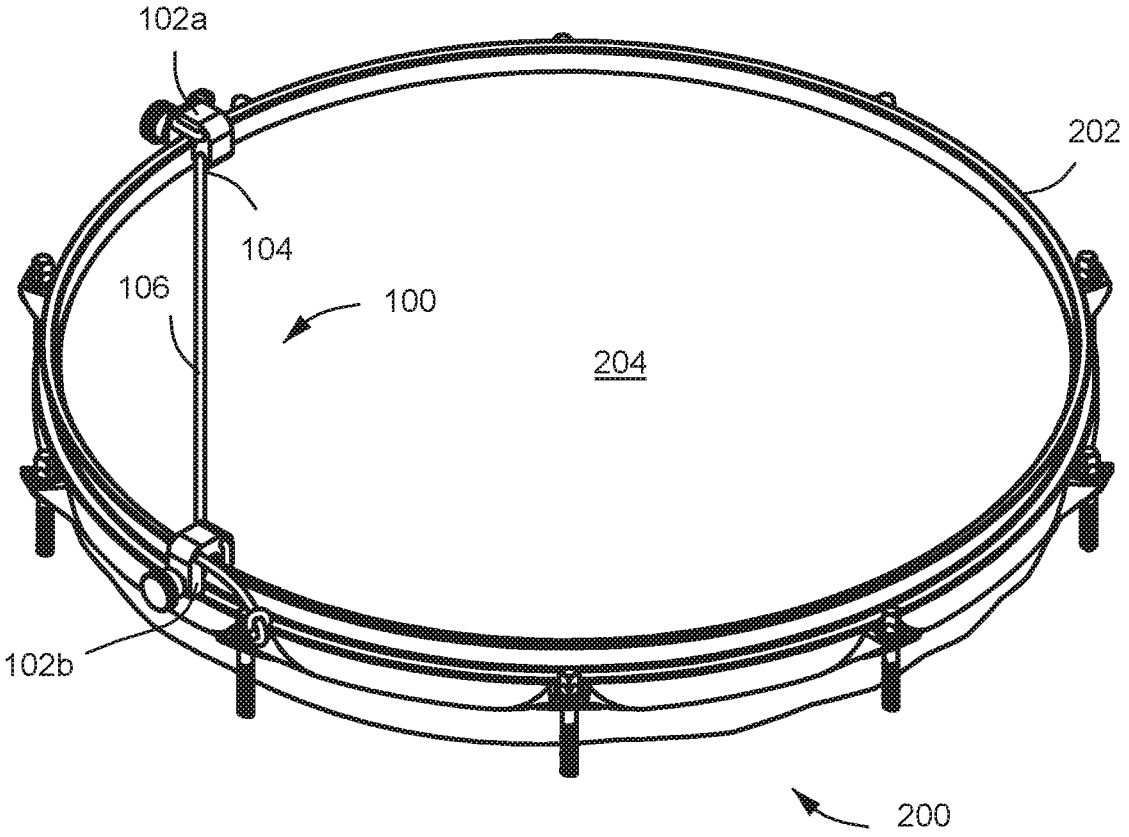
FIG. 5 illustrates a perspective view of a drum coupling assembly including a drum and a cord having a restraining portion extending across a drumhead of the drum.

Referring to FIG. 3 and FIG. 4, first apertures 308*a*, 308*d* may be disposed laterally through the first terminals 304*a*, 304*c* of the clamps 102*a*, 102*b*, respectively. Preferably, the first apertures 308*a*, 308*d* are disposed at a lower end of the respective first terminals 304*a*, 304*c*. Second apertures 308*b*, 308*e* may be disposed laterally through the bodies 302*a*, 302*b*, respectively. Third aperture 308*c*, 308*f* may also be disposed laterally through the bodies 302*a*, 302*b*, respectively.

The apertures 308*a-f* may each receive a portion of the cord 104. Through the first clamp 102*a*, the cord 104 may extend through the first aperture 308*a* and third aperture 308*c* in a first direction and may extend through the second aperture 308*b* in a second, e.g., opposite, direction. Through the second clamp 102*b*, the cord 104 may extend through the first aperture 308*d* and third aperture 308*f* in a first direction and may extend through the second aperture 308*e* in a second, e.g., opposite, direction.

Figure 17:
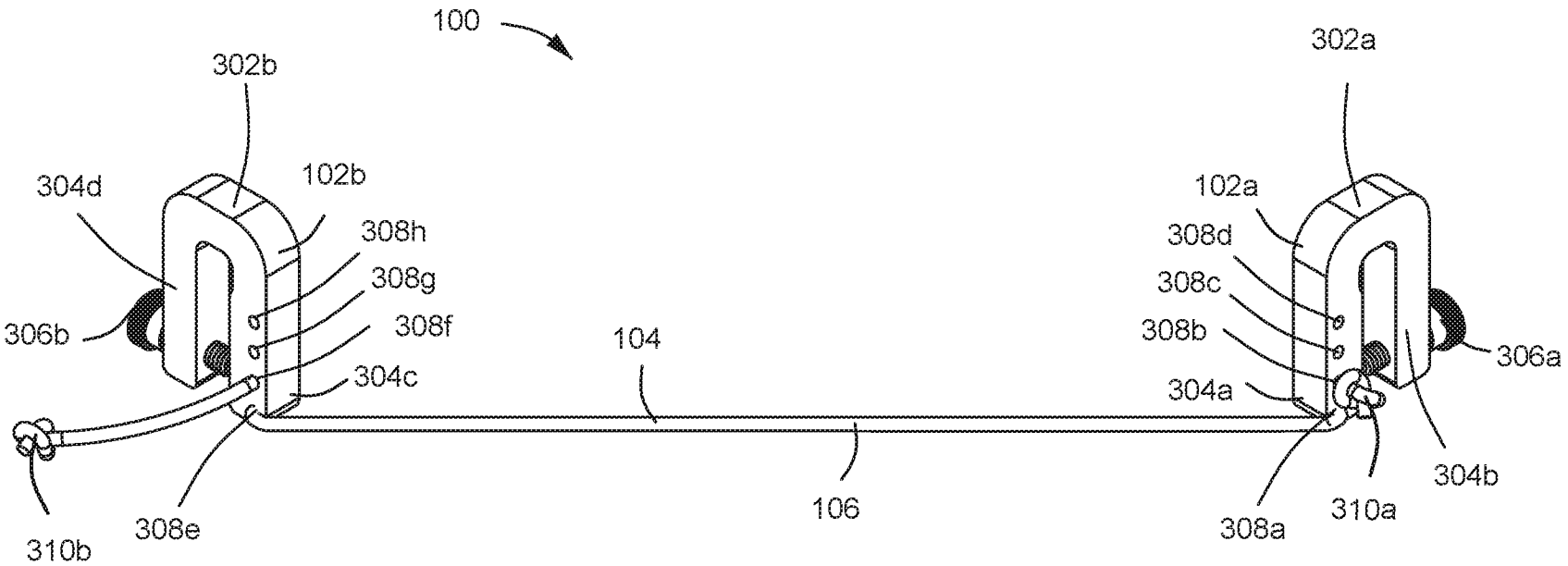
FIG. 17 illustrates a perspective view of a drum coupling assembly including two clamps, in which each clamp has four apertures disposed therein, and a cord coupled to the two clamps.
Figure 18:
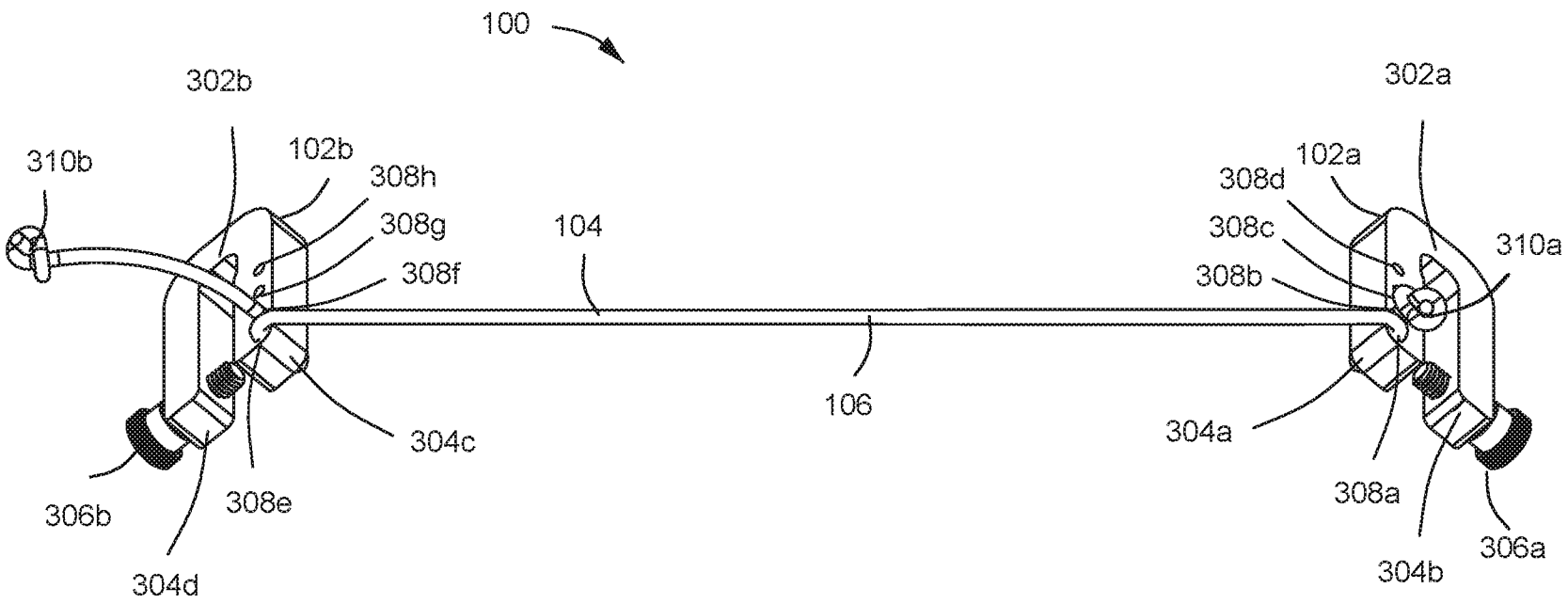
FIG. 18 illustrates a worms-eye perspective view of a drum coupling assembly including two clamps, in which each clamp has four apertures disposed therein, and a cord coupled to the two clamps.

Referring to FIG. 17 and FIG. 18, apertures 308*a-h* may be disposed laterally through the first terminals 304*a*, 304*c* of the clamps 102*a*, 102*b*, respectively. Preferably, the first apertures 308*a*, 308*e* are disposed at a lower end of the respective first terminals 304*a*, 304*c*.

The apertures 308*a-h* may each receive a portion of the cord 104. Through the first clamp 102*a*, the cord 104 may extend through the aperture 308*a* in a first direction and may extend through the second aperture 308*b* in a second, e.g., opposite, direction. Through the second clamp 102*b*, the cord 104 may extend through the aperture 308*e* in a first direction and may extend through the second aperture 308*f* in a second, e.g., opposite, direction.

Referring to FIGS. 1-4, 6, 9, 11, 14-18, 20, 25, and 28, clamps 102*a*, 102*b* may remain coupled to a cord 104 because the outer surface of the cord 104 may be abutted against inner surfaces of the clamps 102*a*, 102*b*. Moreover, the outer surface of the cord 104 may be in physical contact with the inner surfaces of the clamps 102*a*, 102*b*. The inner surfaces may define apertures 308 in the clamps 102*a*, 102*b*. Accordingly, friction between the cord 104 and the inner surfaces of the clamps 102*a*, 102*b* would inhibit each clamp 102 from sliding relative to the cord 104.

However, a percussionist may pull on the cord 104 to slide one or more portions of the cord 104 across the inner surfaces of a clamp 102. Pulling on the cord 104 may cause one or more portions of the cord 104 adjacent the inner surfaces of the clamp 102 to be stretched, e.g., elongated. When stretched, the one or more portions of the cord 104 would deform to have a smaller diameter. Friction would be reduced between the stretched one or more portions of the cord 104 and the adjacent inner surfaces. Thus, the one or more portions of the cord 104 may be slid through the clamp 102.

Referring to FIGS. 1-28, a percussionist may couple clamps 102*a*, 102*b* and a cord 104 to a drum hoop 202 of a drum 200 as follows. First, the percussionist may couple a first clamp 102*a* to a first portion of the drum hoop 202. The percussionist may turn a thumb screw 306*a* clockwise to cause the thumb screw 306*a* to be extending through a second terminal 304*b* of the first clamp 102*a*. The thumb screw 306*a* may be turned clockwise until it is abutted against an outer surface of the drum hoop 202 and a terminal 304*a* of the clamp 102*a* is abutted against an inner surface of the first portion of the drum hoop 202.

Next, the percussionist may pull a second clamp 102*b* towards a second portion of the drum hoop 202. The percussionist may couple the second clamp 102*b* to the second portion of the drum hoop 202. The percussionist may turn a thumb screw 306*b* clockwise to cause the thumb screw 306*b* to be extending through a second terminal 304*d* of the second clamp 102*b*. The thumb screw 306*b* may be turned clockwise until it is abutted against an outer surface of the drum hoop 202 and a terminal 304*c* of the clamp 102*b* is abutted against an inner surface of the second portion of the drum hoop 202.

A restraining portion 106 of a cord 104 may be extending from the first portion of the drum hoop 202 to a second portion of the drum hoop 202. Accordingly, the restraining portion 106 may be stretched between the first portion and a second portion of the drum hoop 202. The restraining portion 106 may also be stretched across a drumhead 204 of the drum 200. Additionally, the restraining portion 106 may be parallel to the drumhead 204.

Afterwards, the percussionist may couple a percussive effects object (not shown) to the restraining portion 106 of the cord 104 and the drumhead 204 in various configurations. In a first configuration, the percussionist may hang, e.g., with a hook or a clip, a percussive effects object onto the restraining portion 106. A portion of the percussive effects object may be in physical contact with, e.g., abutted against, the drumhead 204.

In a second configuration, the percussionist may prefer to rest the percussive effects object against the drumhead 204 and the restraining portion 106 of a cord 104. Essentially, the restraining portion 106 may provide a barrier that inhibits the percussive effects object from being moved past the cord 104. Accordingly, in some cases, if the drumhead 204 were positioned parallel to the ground and vibration were imparted to the drumhead 204, the vibration would cause the percussive effects object to move relative to the drumhead 204. However, the cord 104 would inhibit movement of the percussive effects object in the direction of the cord 104. In other cases, if the drumhead 204 were positioned at a tilt, e.g., angle, relative to the ground, the cord 104 would inhibit the percussive effects object from being slid past the cord 104, down the drumhead 204.

In a third configuration, the percussionist may position the percussive effects object between the drumhead 204 and the restraining portion 106. First, the percussionist may pull the restraining portion 106 away from the drumhead 204. Moreover, the restraining portion 106 may be pulled orthogonally to the drumhead 204. Pulling on the restraining portion 106 may stretch, e.g., elongate, and/or increase tension on the restraining portion 106. Next, the percussionist may set the percussive effects object between the drumhead 204 and the restraining portion 106. Then, the percussionist may release the restraining portion 106. An upper surface of the percussive effects object may now be abutted against the restraining portion 106. Also, a lower surface of the percussive effects object may be abutted against the drumhead 204. Accordingly, friction between the drumhead 204, the percussive effects object, and the restraining portion 106 may inhibit movement of the percussive effects object relative to the drumhead 204 and/or the restraining portion 106.

In some cases, an unstretched restraining portion 106 of a cord 104 may be longer than the shortest distance, e.g., line or geometric chord, from a first portion of the drum hoop 202 to a second portion of the drum hoop 202. Two clamps 102*a*, 102*b* may be respectively coupled to the first portion and the second portion of the drum hoop 202. In such cases, a percussive effects object may not be retained on and/or between the restraining portion 106 and a drumhead 204. The percussionist may want to shorten the unstretched restraining portion 106. First, the percussionist may pull a first end of the cord 104 through one or more apertures 308 (FIGS. 1-4 and 15-19) disposed through the clamp 102*a*. Then, the percussionist may slide a first clamp 102*a* towards the midpoint of the cord 104. The length of the unstretched restraining portion 106 may now be shorter. The now shorter restraining portion 106 may be stretched such that tension exists on the restraining portion 106.

In other cases, a stretched restraining portion 106 of a cord 104 may be shorter than the shortest distance from a first portion of the drum hoop 202 to a second portion of the drum hoop 202. In such cases, to couple the cord 104 to the first portion and the second portion of the drum hoop 202, the percussionist may increase the length and/or tension of the restraining portion 106. First, the percussionist may pull on the restraining portion 106 to cause an end portion of the cord 104 to be slid through apertures 308 (FIGS. 1-4 and 15-19) disposed in a first clamp 102*a*. At the same time, the first clamp 102*a* may be slid away from the midpoint of the cord 104. Thus, the length of the unstretched restraining portion 106 may now be longer.

The percussionist may then release the restraining portion of the cord 104. Accordingly, the outer surface of the cord 104 would be abutted against one or more inner surfaces of the first clamp 102*a*. Thus, the first clamp 102*a* would remain coupled to the cord 104.

The percussionist may further increase the length and/or tension of the restraining portion 106 by performing the same steps above in relation to a second clamp 102*b*, and one or more apertures 308 disposed in the second clamp 102*b*.

Next, the percussionist may couple the two clamps 102*a*, 102*b* to the first portion and the second portion of the drum hoop 202.

In alternate cases, to prevent the cord from being accidently pulled out of a clamp 102, the percussionist may optionally tie a knot 310 on one or both ends of the cord 104. In other cases, the percussionist may optionally couple a cord lock (not shown) on one or both ends of the cord 104. When the cord 104 is pulled, the knot 310 or the cord lock would be abutted against a clamp 102. Thus, the knot 310 or the cord lock would inhibit ingress or egress of the cord 104 through the clamp 102.

Other alternative versions of drum coupling assemblies may be described in reference to FIGS. 15-28. There are two drawing pages for each of two other designs represented in the drawings attached for the Strap/Cord Attachment and Spanning Devices (four drawing pages total). A strap/cord attachment and spanning devices may also be referred to as "a drum coupling assembly." Each of the two designs function the same way but have different dimensions to accommodate use on either a drum rim, or drum hoop. FIGS. 15, 16, 19, 20, 21, 22 and 23 correspond to the Strap/Cord Attachment and Spanning Devices for a standard size drum rim. FIGS. 17, 18, 24, 25, 26, 27, and 28, correspond to the Strap/Cord Attachment and Spanning Devices for a standard size drum hoop. Because the two designs function the same way, many of the figures demonstrate the same principals and details and can be interchangeable. The figure sets that demonstrate the same principals and details are: FIGS. 15 & 17, FIGS. 16 & 18, FIGS. 19 & 24, FIGS. 20 & 25, FIGS. 21 & 26, FIGS. 22 & 27, FIGS. 23 & 28.

FIGS. 15, 16, 17 and 18 shows angled views of the complete Strap/Cord Attachment and Spanning System assembly, which includes: 2× Strap/Cord Attachment and Spanning Devices, and 1× cord/strap. They also show that one Strap/Cord Attachment and Spanning Devices consists of, 1× Mount Body, and 1× Thumb Screw.

Figure 19:
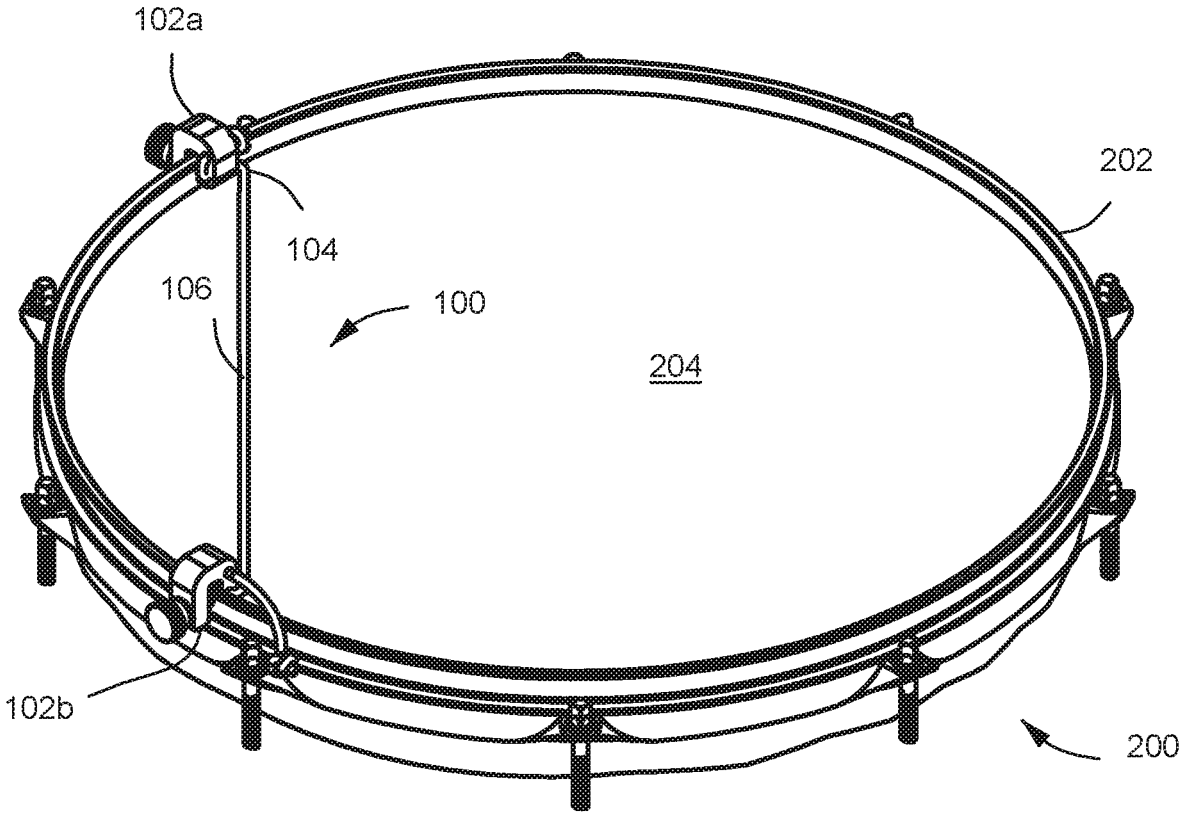
FIG. 19 illustrates a perspective view of a drum coupling assembly including a drum and a cord having a restraining portion extending across a drumhead of the drum.
Figure 24:
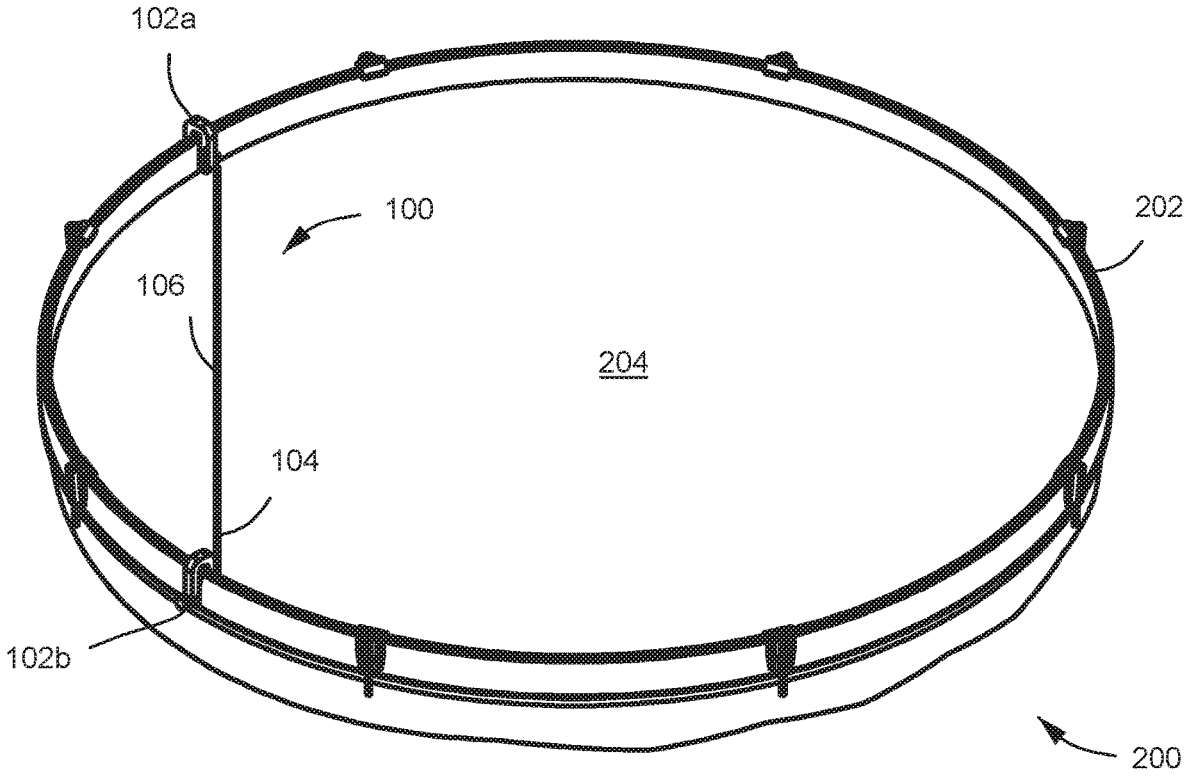
FIG. 24 illustrates a perspective view of a drum coupling assembly including a drum and a cord having a restraining portion extending across a drumhead of the drum.

FIG. 19 and FIG. 24 show isometric views of the Strap/Cord Attachment and Spanning System installed on a drum.

FIG. 20 and FIG. 25 show detail views from FIG. 19 and FIG. 24 respectively. The views are close-ups of the Strap/Cord Attachment and Spanning Device installed on a drum rim and hoop.

Figure 21:
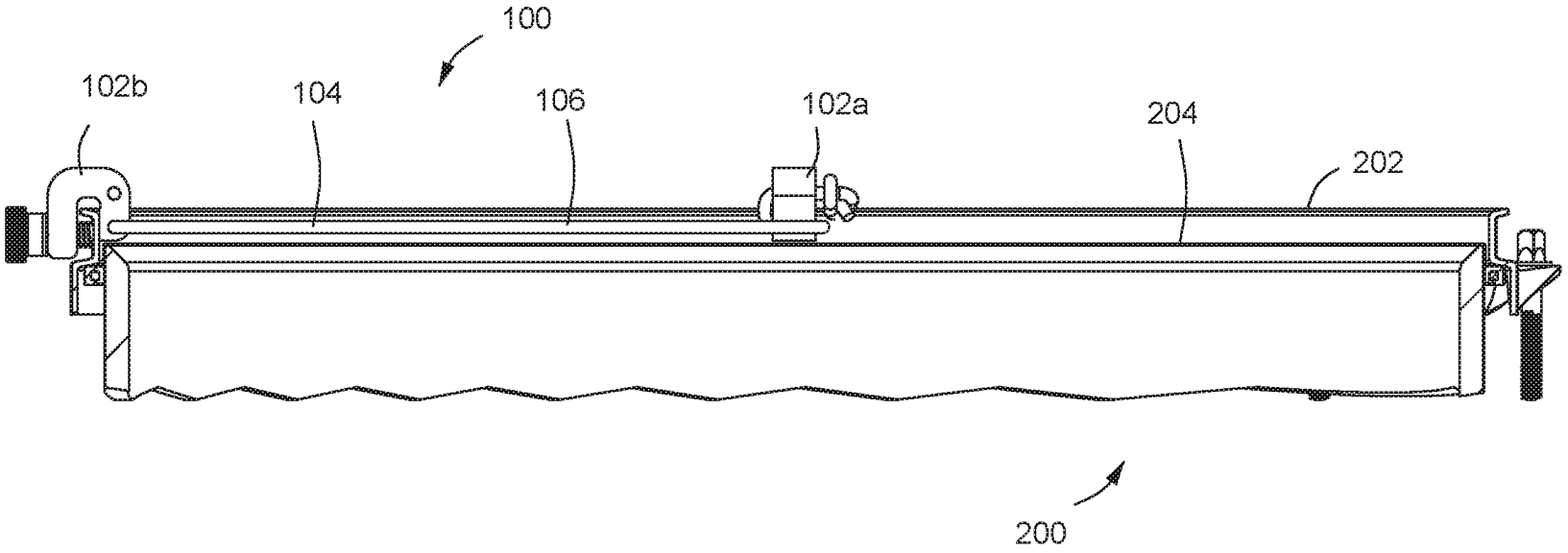
FIG. 21 illustrates a cross-sectional side view of a drum having two clamps coupled to a drum hoop of the drum.
Figure 22:
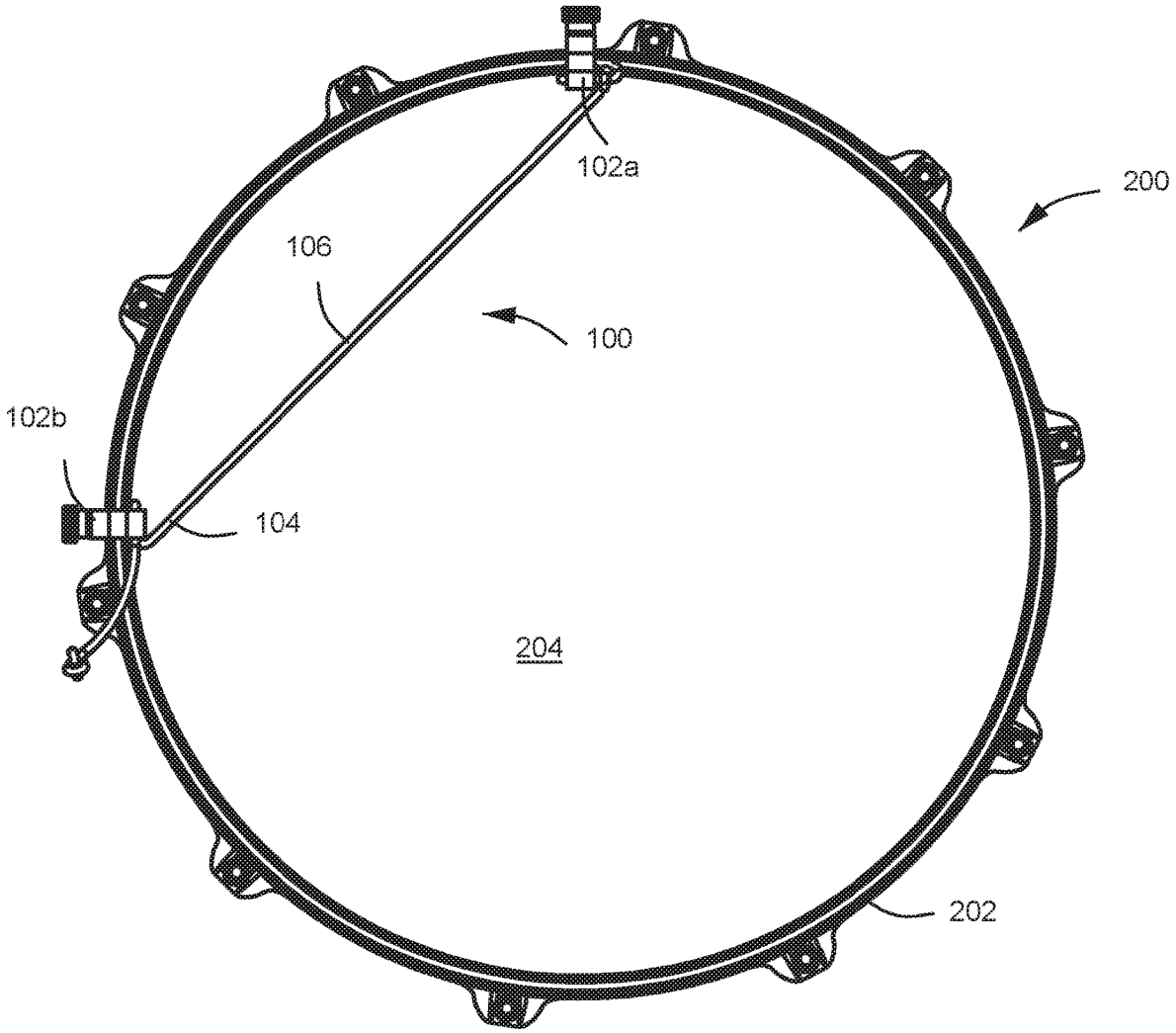
FIG. 22 illustrates a top plan view of a drum coupling assembly including a drum and a cord having a restraining portion extending across a drumhead of the drum.
Figure 26:
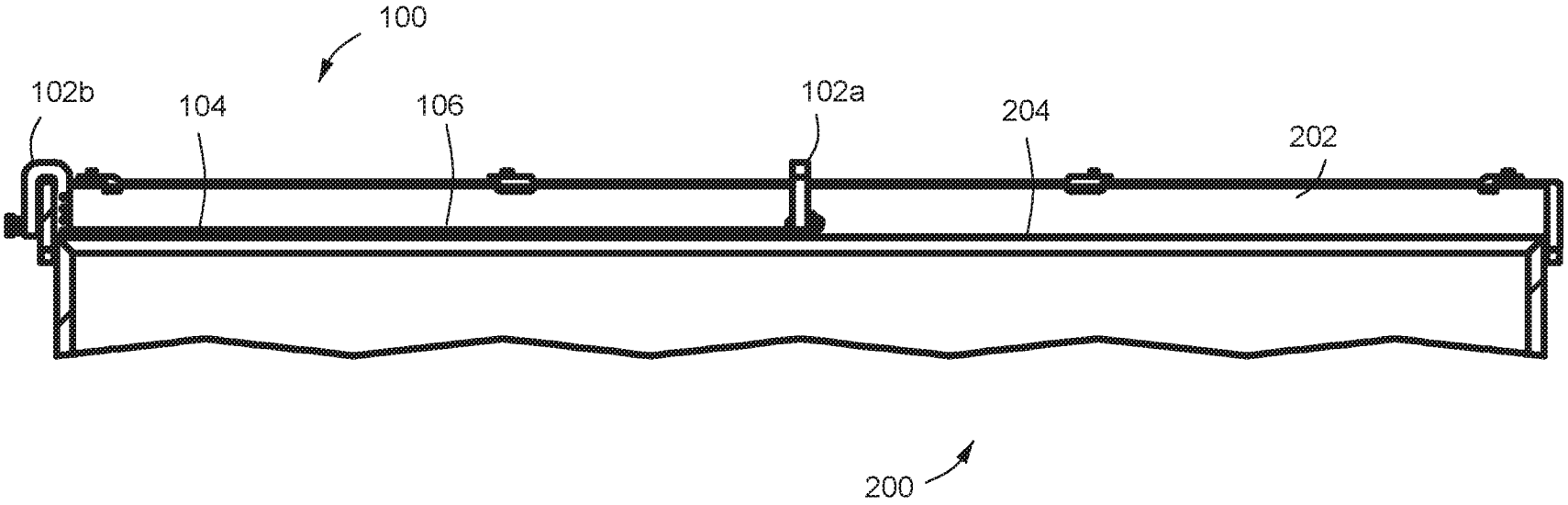
FIG. 26 illustrates a cross-sectional side view of a drum having two clamps coupled to a drum hoop of the drum.
Figure 27:
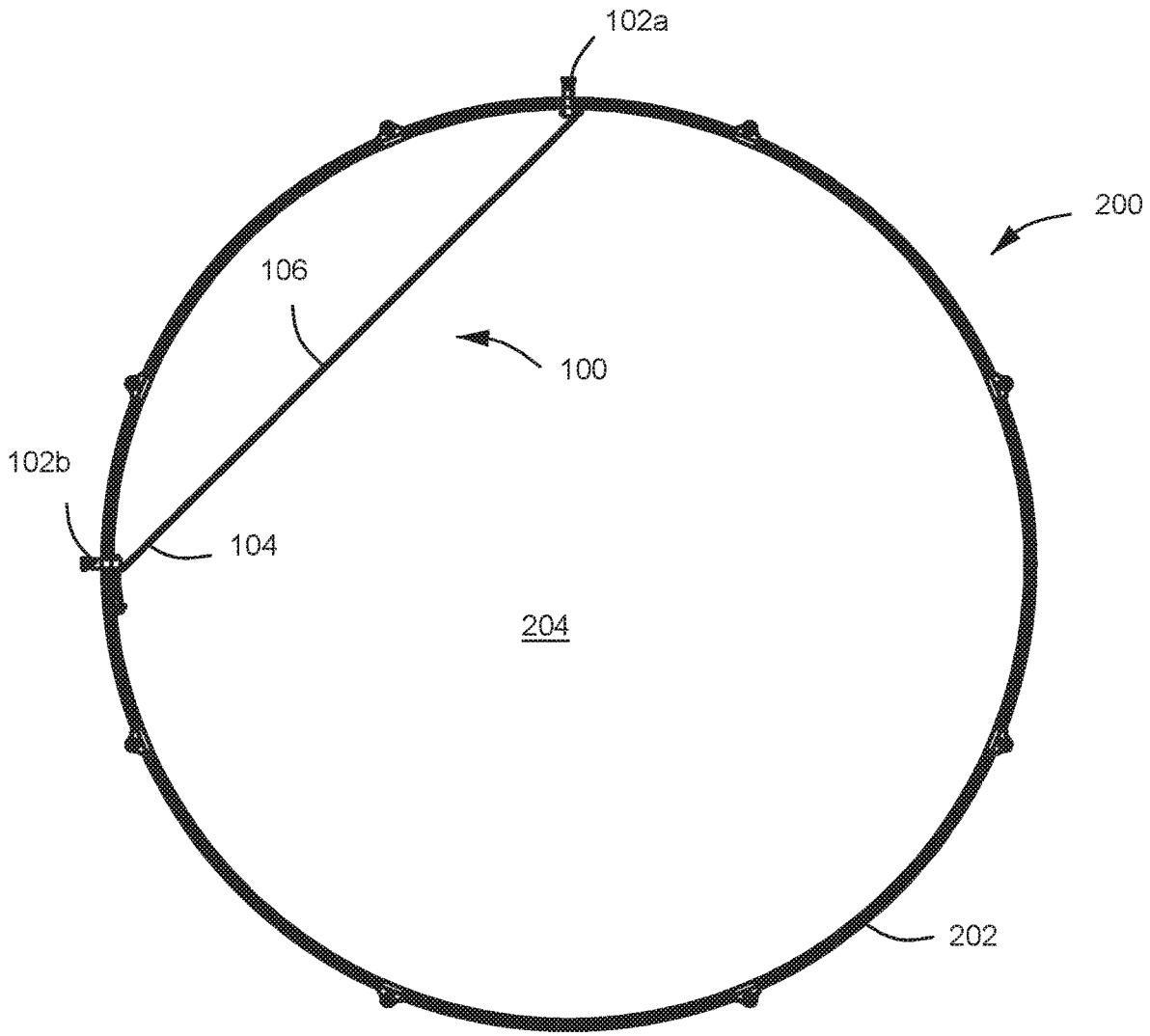
FIG. 27 illustrates a top-plan view of a drum coupling assembly including a drum and a cord having a restraining portion extending across a drumhead of the drum.

FIG. 21 and FIG. 26 show section views of FIG. 22 and FIG. 27, for the purpose of providing a clear side view of the Strap/Cord Attachment and Spanning Devices on a drum rim and hoop.

FIG. 22 and FIG. 27 show plan views of the Strap/Cord Attachment and Spanning System installed on a drum.

FIG. 23 and FIG. 28 show detail views from FIG. 21 and FIG. 26 respectively. The views are close-ups of the sides of the Strap/Cord Attachment and Spanning Devices installed on a drum rim and hoop.

Other versions of drum coupling assemblies may be described in reference to FIG. 23 and FIG. 28, which show the general U-shape of the Mount Body on the Strap/Cord Attachment and Spanning Device. The dimensions for the Strap/Cord Attachment and Spanning Device shown in FIG. 23, are the appropriate sizes for a standard drum rim to fit inside the U-shape, and the dimensions for the Strap/Cord Attachment and Spanning Device shown in FIG. 28, are the appropriate sizes for a standard drum hoop to fit inside the U-shape. This geometry allows the Strap/Cord Attachment and Spanning Device to be attached to a drum rim or hoop by means of clamping the Mount Body against the drum rim or hoop using a thumb screw threaded into the back portion of the Mount Body with the tightening head of the thumb screws on the outside of the drum rim or hoop away from the drumhead. This clamping process can be easily loosened and tightened for simple and quick location and height adjustments of the Strap/Cord Attachment and Spanning Devices on the drum rim or hoop. This clamping mechanism does not need to be the mechanism for attaching the Strap/Cord Attachment and Spanning Device to a drum rim or hoop. A spring clamp, flexible clamp or other attachment system could also be used.

FIGS. 19, 22, 24 and 27, show how 2*x* Strap/Cord Attachment and Spanning Devices clamp onto two separate locations of a drum rim or hoop, and how each of the two ends of a strap/cord, with some elasticity, are attached to one of the two Strap/Cord Attachment and Spanning Devices by lacing them through the holes on the Mount Body, allowing the strap/cord to span between them and across the surface of a drumhead. Changing the span of the strap/cord between the two Strap/Cord Attachment and Spanning Devices allows for different sized objects to be held or corralled in different locations on the drumhead surface by the strap/cord.

Additionally, FIGS. 19, 20, 22, 24, 25 and 27, show how the strap/cord ends loop around the outside of the Strap/Cord Attachment and Spanning Devices and lace through holes on the Mount Bodies allowing tension adjustment by feeding slack on the strap/cord in and out of the holes on the Mount Bodies. Lacing the strap/cord to the Strap/Cord Attachment and Spanning Device does not need to be the mechanism for attaching and adjusting the strap/cord to the Strap/Cord Attachment and Spanning Device. Other methods of attachment and adjustment can be used.

FIGS. 19, 20, 22, 24, 25 and 27 illustrate use in the Strap/Cord Attachment and Spanning System with their respective details and notes, demonstrate how the elasticity in the strap/cord allow it to be held tight against and between the Strap/Cord Attachment and Spanning Device's Mount Bodies when no slack is present.

As shown in FIGS. 19, 22, 24 and 27, a combination of the strap/cord wrapping around the outside of the Mount Bodies in tension, and the friction caused by this, the hole sizes and hole locations on the Mount Bodies, prevent the strap/cord from loosening during drum vibrations and playing operations, and allow for the strap/cord to be tensioned as desired.

The construction details of the various disclosed drum coupling assemblies are that the separate components be made of plastic, metal or any other material that is sufficiently rigid and strong enough to withstand all the required clamping pressures, drum vibrations and impacts from other objects. Furthermore, it should be made from a material that will not damage a drum rim or hoop.

The advantages of the disclosed drum coupling assemblies include a simple device which allows for simple placement, security and control of various objects placed against a drumhead surface at any angle, there is a wide range of objects and materials that can be used, changes of the location and pressure of the objects placed on a drumhead is quick and simple allowing for experimentation and customization, it is small and can be transported very easily and is minimally invasive when attached to a drum rim or hoop, the drum coupling assemblies do not damage drumheads as adhesives would, and the drum coupling assemblies can suspend the strap/cord above the drumhead so the strap/cord does not disrupt the natural vibrations and resonance of the drum when it is not holding an object in place.

The disclosed drum coupling assemblies allow a strap/cord to be attached to a drum rim or hoop and be spanned across the surface of the drumhead.

The disclosed drum coupling assemblies prevent objects from falling off a drumhead due to contact with the object during playing and/or drum vibrations.

The disclosed drum coupling assemblies prevent undesired movement of an object placed against a drumhead.

The disclosed drum coupling assemblies allow for control of an object's location on a drumhead through the placement and position of the Strap/Cord Attachment and Spanning Devices.

The disclosed drum coupling assemblies allow for pressure control of an object against a drumhead through the tightening or loosening of the strap/cord from the Strap/Cord Attachment and Spanning Devices.

While the foregoing written description of the disclosed drum coupling assemblies enables one of ordinary skill to make and use what is considered presently to be the best mode thereof, those of ordinary skill will understand and appreciate the existence of variations, combinations and equivalents of the specified embodiment, method and examples herein. The inventions should therefore not be limited by the above described embodiment, method and examples, but by all embodiments and methods within the scope and spirit of the inventions as claimed.

What is claimed as the invention is:

1. A drum coupling assembly, comprising:
a drum having a drum hoop and a drumhead;
a first clamp coupled to the drum hoop;
a second clamp coupled to the drum hoop; and
an elastic cord, wherein at least a portion of the elastic cord extends between the first clamp and the second clamp, and wherein at least a portion of the elastic cord is disposed between an edge of the drum hoop and the drumhead, wherein the first clamp or the second clamp or both the first clamp and the second clamp each comprises a terminal having an aperture extending through the terminal, and wherein a portion of the elastic cord extends through the aperture.

2. The drum coupling assembly of claim 1, wherein the portion of the elastic cord extending between the first clamp and the second clamp extends from the first clamp and the second clamp.

3. The drum coupling assembly of claim 1, wherein a first portion of the elastic cord is coupled to the first clamp and a second portion of the elastic cord is coupled to the second clamp.

4. The drum coupling assembly of claim 1, wherein the first clamp and the second clamp hold a portion of the elastic cord within the drum hoop.

5. The drum coupling assembly of claim 1, wherein at least a portion of the elastic cord is disposed parallel to the drumhead and is configured to be capable of restraining an object between the elastic cord and the drumhead.

6. The drum coupling assembly of claim 1, wherein at least a portion of the elastic cord that extends between the first clamp and the second clamp is not in physical contact with the drumhead.

7. The drum coupling assembly of claim 1, wherein at least a portion of the elastic cord that extends between the first clamp and the second clamp is disposed at least 1.0 millimeter away from the drumhead.

8. The drum coupling assembly of claim 1, wherein the first clamp or the second clamp, or both the first clamp and the second clamp each comprises:
a first aperture; and
a second aperture, wherein the elastic cord extends through the first aperture in a first direction and the second aperture in a second direction.

9. The drum coupling assembly of claim 1, the first clamp or the second clamp, or both the first clamp and the second clamp each comprises:
a first aperture; and a second aperture, wherein the elastic cord extends through the first aperture in a first direction and the second aperture in a second direction.

10. The drum coupling assembly of claim 1, wherein the first clamp or the second clamp, or both the first clamp and the second clamp each comprises:

a body having an aperture extending therethrough; and a terminal extending from the body, the terminal having an aperture extending laterally through an end of the terminal, wherein the elastic cord extends through the aperture of the terminal and the aperture of the body.

11. A drum coupling assembly, comprising:

a first clamp capable of being coupled to a drum hoop of a drum, the first clamp having a first terminal having an aperture;

a second clamp capable of being coupled to the drum hoop, the second clamp having a second terminal having an aperture; and an elastic cord extending through the aperture of the first terminal and the aperture of the second terminal, wherein the first aperture and the second aperture are capable of being disposed between an edge of the drum hoop and a drumhead of the drum.

12. The drum coupling assembly of claim 11, wherein the first clamp and the second clamp are capable of holding a portion of the elastic cord within the drum hoop.

13. The drum coupling assembly of claim 11, wherein the elastic cord is capable of ingress or egress, or both, through the first clamp and the second clamp.

14. The drum coupling assembly of claim 11, wherein an outer surface of the elastic cord is abutted against an inner surface of the first clamp and an inner surface of the second clamp.

* * * * *